US010533817B1

(12) United States Patent
Hefer et al.

(10) Patent No.: US 10,533,817 B1
(45) Date of Patent: Jan. 14, 2020

(54) ELECTRIC MAGAZINE LOADER

(71) Applicant: Vista Outdoor Operations LLC, Farmington, UT (US)

(72) Inventors: Brandon Thomas Hefer, St. Louis, MO (US); Brandon Karl Trostrud, St. Louis, MO (US)

(73) Assignee: Vista Outdoor Operations LLC, Farmington, UT (US)

( * ) Notice: Subject to any disclaimer, the term of this patent is extended or adjusted under 35 U.S.C. 154(b) by 15 days.

(21) Appl. No.: 16/015,026

(22) Filed: Jun. 21, 2018

Related U.S. Application Data

(60) Provisional application No. 62/522,784, filed on Jun. 21, 2017.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84; B65G 47/1407; B65G 47/1457
See application file for complete search history.

(56) References Cited

U.S. PATENT DOCUMENTS 3,526,028 A 9/1970 Winch
4,425,834 A 1/1984 Lohmann
4,464,855 A 8/1984 Musgrave
4,689,909 A 9/1987 Howard
4,719,715 A 1/1988 Howard
4,739,572 A 4/1988 Brandenburg
4,827,651 A 5/1989 Conkey
4,829,693 A 5/1989 Holmes
4,879,829 A 11/1989 Miller et al.
4,888,902 A 12/1989 Knowles
4,939,862 A 7/1990 Brandenburg et al.
4,949,495 A 8/1990 Mari
4,970,820 A 11/1990 Miller et al.
4,993,180 A 2/1991 Upchurch
5,249,386 A 10/1993 Switzer
5,301,449 A 4/1994 Jackson
5,355,606 A 10/1994 Origoni
5,377,436 A 1/1995 Switzer
6,178,683 B1 1/2001 Williams
6,810,616 B2 11/2004 Tal et al.
(Continued)

*Primary Examiner* — Benjamin P Lee
(74) *Attorney, Agent, or Firm* — Walter M. Egbert, III; Gerard M. Donovan; Reed Smith LLP

(57) ABSTRACT

A magazine loader for loading cartridges into a magazine includes a base and a housing supported by the base. The base and the housing support a bowl for receiving a plurality of cartridges. A wheel is disposed inside the bowl cavity defined by the bowl. Cartridges are circulated in the bowl upon rotation of the wheel and exit the bowl via an aperture while the cartridges are assuming either a first orientation or a second orientation. A series of cartridges having random orientations are fed to a sorter of the magazine loader. The sorter is operable to receive a first cartridge and rotate the first cartridge clockwise 90 degrees if the random directional orientation of the first cartridge is the first directional orientation and/or rotate the first cartridge counterclockwise 90 degrees if the random directional orientation of the first cartridge is the second directional orientation.

21 Claims, 19 Drawing Sheets

(56) References Cited

U.S. PATENT DOCUMENTS

| | | | | |
|---|---|---|---|---|
| 6,817,134 | B2 | 11/2004 | Newman | |
| 7,059,077 | B2 | 6/2006 | Tal et al. | |
| 7,257,919 | B1 | 8/2007 | Farley | |
| 7,383,657 | B2 | 6/2008 | Pikielny | |
| 7,487,613 | B2 | 2/2009 | Taylor | |
| 7,503,138 | B2 | 3/2009 | Tal et al. | |
| 7,552,668 | B1 * | 6/2009 | Gonzalez | F42B 33/00 86/45 |
| 7,637,048 | B2 | 12/2009 | Tal et al. | |
| 7,805,874 | B2 | 10/2010 | Tal et al. | |
| 8,096,403 | B2 * | 1/2012 | Marti Sala | B65G 47/1457 198/384 |
| 8,453,366 | B2 | 6/2013 | Gray | |
| 9,182,185 | B2 | 11/2015 | Hatch | |
| 9,212,859 | B1 | 12/2015 | Tal et al. | |
| 9,239,198 | B2 | 1/2016 | McPhee | |
| 9,273,917 | B1 | 3/2016 | Buckner | |
| 9,347,722 | B1 | 5/2016 | Morris | |
| 9,404,697 | B2 | 8/2016 | Cobb | |
| 9,612,070 | B2 | 4/2017 | Hatch | |
| 9,631,884 | B2 | 4/2017 | Kim | |
| 9,644,910 | B2 | 5/2017 | Kim | |
| 9,719,741 | B1 | 8/2017 | Cifers et al. | |
| 9,939,218 | B2 * | 4/2018 | Mokuolu | F41A 9/83 |
| 9,989,342 | B1 * | 6/2018 | Lougeay | F42B 33/002 |
| 2003/0046854 | A1 | 3/2003 | Urchek | |
| 2007/0012546 | A1 * | 1/2007 | Herzog | B65G 47/1457 198/392 |
| 2013/0125737 | A1 * | 5/2013 | Koskela | B65G 47/1457 86/45 |
| 2013/0152771 | A1 * | 6/2013 | Coma Asensio | B65G 47/1457 86/19.5 |
| 2014/0033592 | A1 | 2/2014 | Fiorucci | |
| 2016/0305726 | A1 * | 10/2016 | Mokuolu | F41A 9/83 |

* cited by examiner

ELECTRIC MAGAZINE LOADER

CROSS-REFERENCE TO RELATED APPLICATION

This application claims the benefit of U.S. Provisional Application No. 62/522,784, filed Jun. 21, 2017, the disclosure of which is hereby incorporated by reference in its entirety.

BACKGROUND OF THE DISCLOSURE

In order to maintain their proficiency with various types of firearms, military personnel, law enforcement officers and hunters frequently engage in target practice. Target practice is often performed at a shooting range with 300 or more cartridges being fired at each practice session. In the sport of hunting, marksmanship is practiced so that a shot can be carefully placed to ensure a quick, clean and humane kill. For military personnel, good marksmanship may make the difference between victory and defeat in battlefield situations.

Many firearms, including pistols and rifles, are designed to utilize a removable magazine that holds ammunition cartridges. The use of a magazine allows a plurality of cartridges to be easily loaded into the firearm by inserting a single magazine into the firearm. After each cartridge is fired, a manually or automatically operated mechanism moves the bolt of the firearm backward and then forward again. The upper most cartridge in the magazine is pulled off of a stack of cartridges each time the mechanism cycles so that cartridges are fed one-by-one into the firing chamber of the firearm. Each magazine typically has an elongate housing defining a chamber with a spring loaded follower slidably disposed therein. The force of the spring loaded follower urges each cartridge in the magazine toward the upper most position in the where the bolt can push it into the firing chamber. When all of the cartridges have been fired, the empty magazine is removed from the firearm and a new magazine is inserted in its place. The empty magazine may then be refilled with cartridges.

SUMMARY

In embodiments, a magazine loader for loading cartridges into a magazine comprises a circular hopper including a bowl portion defining a bowl cavity. The circular hopper may include a wheel disposed inside the bowl cavity. The wheel having a drive system and rotatable about a rotational axis. The wheel defining a plurality of cartridge receiving pockets at a periphery of the wheel, each pocket being configured to receive an individual cartridge in two directional orientations. The bowl portion may define an exit aperture communicating with the bowl cavity for serially exiting of cartridges received in the pockets. In embodiments, the wheel can have the rotational axis being disposed at an acute angle relative to vertical thereby providing a lifting wheel with the exit aperture at an elevated position of the wheel. In embodiments the rotational axis may be vertical.

In embodiments, the magazine loader includes a chute positioned to receive the series of cartridges exiting the exit aperture. In embodiments, the chute is configured to receive and transfer individual cartridges of the series of cartridges in a horizontal orientation and in either of the two directional orientations and to position the series of cartridges above a pivotable plate of a sorter. The sorter may comprise the pivotable plate and a drive system for the pivotable plate. The pivotable plate may define a shaped opening dimensioned and configured to receive individual cartridges in the two directional rotations. The pivotable plate may be rotatable by the drive system in either of the two directional rotations, clockwise and counterclockwise, for orienting the series of cartridges in a single directional orientation. In embodiments, the sorter has a gravity fed exit slot to a directionally oriented cartridge pathway, the pathway extending to a cartridge loading region adjacent a magazine receiver. The magazine receiver configured to secure a magazine to be loaded therein. A loader mechanism of the magazine loader may be positioned proximate the cartridge loading region, the loader mechanism having a powered pusher for horizontally serially loading individual cartridges in the cartridge loading region into a magazine secured in the magazine receiver.

In embodiments, a method for loading a plurality of cartridges into a magazine comprises receiving an unordered batch of cartridges within a circular hopper defining a bowl cavity. In embodiments, the circular hopper includes a lifting wheel disposed inside the bowl cavity and the lifting wheel rotates about a rotational axis that is disposed at an acute angle relative to vertical. The lifting wheel may be rotated so that a series of cartridges are received in a plurality of cartridge receiving pockets defined by the lifting wheel and each cartridge is lifted to an exit aperture defined by a bowl portion of the circular hopper. A series of cartridges may be dropped through the exit aperture and into a chute. The series of cartridges may slide down the chute in a horizontal orientation to stack against a pivotable plate of a sorter. The pivotable plate may define a shaped opening that is dimensioned and configured to receive an individual cartridge with each individual cartridge assuming a random directional orientation of one of two directional orientations, the random directional orientation being a first directional orientation and an opposite second directional orientation. In embodiments, the method includes determining whether the random directional orientation of each of the series of cartridges received in the shaped opening is the first directional orientation or the second directional orientation. The pivotable plate may be rotated clockwise 90 degrees if the random directional orientation of each of the series of cartridges received in the shaped opening is the first directional orientation and the pivotable plate may be rotated counterclockwise 90 degrees if the random directional orientation of each of the series of cartridges received in the shaped opening is the second directional orientation. Each cartridge may be allowed to fall through an exit slot defined by a stationary plate located below the pivotable plate so that each cartridge drops into the cartridge loading region of a loader mechanism whereby each cartridge is directionally oriented in the same direction. Each of the series of cartridges may be pressed into a captured magazine by a pusher of the loader mechanism.

In embodiments, a magazine loader in accordance with this detailed description may comprise circuitry operatively coupled to a first cartridge tip detector and a second cartridge tip detector. The first cartridge tip detector may be positioned such that the first cartridge tip detector detects the presence of a cartridge tip portion while a particular cartridge is received in the shaped opening and the particular cartridge is assuming the first directional orientation. The second cartridge tip detector may be positioned such that the second cartridge tip detector detects the presence of a cartridge tip portion while a given cartridge is received in the shaped opening defined by the pivotable plate and the given cartridge is assuming the second directional orientation. Each cartridge tip detector can comprise opto sensors, capacitive sensors, mechanical switches, or other proximity/presence sensing sensors. In embodiments, the tip detectors may comprises a light source and a light sensor. The light source and the light sensor may be positioned such that light emitting from the light source illuminates a portion of the cartridge tip and the light sensor provides a signal responsive to light reflected off of the cartridge tip when the cartridge tip is in the closed position. In embodiments, the light source comprises a light emitting diode (LED) and the light sensor comprises a phototransistor.

In embodiments, a magazine loader for loading cartridges into a magazine, comprises a bowl portion defining a bowl cavity configured to receive a plurality of cartridges. In embodiments, a rotatable lifting wheel of the magazine loader is disposed inside the bowl cavity. The lifting wheel may be capable of circulating cartridges in the bowl upon rotation thereof. A chute of the magazine loader may be positioned with a chute entry at an upper region of the bowl. The chute entry may be dimensioned and configured to allow passage of individual cartridges generally in a horizontal orientation there through while each cartridge is assuming a random directional orientation of one of two directional orientations, the random directional orientation being a first directional orientation or a second directional orientation, the first directional orientation being opposite the second directional orientation. A chute body may define a channel, the channel communicating with the aperture, wherein cartridges that have passed through the chute entry pass down the channel in a horizontal orientation. The chute body may defines a channel exit, the channel exit communicating with the channel, wherein cartridges that have passed through the channel pass out the channel exit in a horizontal orientation. The sorter may comprise a feed guide defining a shaped passageway. The shaped passageway may communicate with the channel exit defined by the chute body, wherein cartridges that have passed through the channel exit pass into the shaped passageway and seat therein in a horizontal orientation and in either of two directional orientations. The sorter may further comprise a pivotable plate positioned below the feed guide. The sorter may have a directional orientation detector and the pivotable plate may receive a cartridge from the feed guide and, depending on orientation, may rotate the pivotable plate to orient the cartridges in a common directional orientation and discharge the cartridges to a loader mechanism opposite a magazine receiver for pushing the horizontal cartridges into a magazine secured by the magazine receiver.

In one or more embodiments, a magazine loader for loading cartridges into a magazine includes a base and a housing supported by the base. The base and the housing may support a bowl for receiving a plurality of cartridges. A wheel is disposed inside the bowl cavity defined by the bowl. Cartridges are circulated in the bowl upon rotation of the wheel and exit the bowl via an aperture while the cartridges are assuming either a first orientation or a second orientation. A series of cartridges having random orientations are fed to a sorter of the magazine loader. The sorter receives a first cartridge of the series and rotates the first cartridge from the first orientation to the second orientation if the random orientation of the first cartridge is the first orientation. The sorter allows passage of the first cartridge without rotation if the random orientation of the first cartridge is the second orientation.

A magazine loading apparatus for loading cartridges into a magazine in accordance with some embodiments comprises a base pivotally supporting a gear and a guide defining a shaped lumen. In some embodiments, the shaped lumen is dimensioned and configured to allow passage of cartridges having a random orientation, the random orientation being either a first orientation or a second orientation. The magazine loading apparatus also includes a sorter for selectively allowing a series of cartridges to exit the shaped lumen defined by the guide. In some embodiments, the series of cartridges comprises a first cartridge, a second cartridge, and a third cartridge. The sorter receives the first cartridge and rotates the first cartridge from the first orientation to the second orientation if the random orientation of the first cartridge is the first orientation. The sorter allows passage of the first cartridge without rotation if the random orientation of the first cartridge is the second orientation.

The sorter may include a toothed plate, a gear and a motor. In some embodiments, the toothed plate defines an opening that is dimensioned and configured to receive cartridges having either the first orientation or the second orientation. The toothed plate includes a plurality of gear teeth in some embodiments. The gear may be pivotally supported by the base at a position such that the gear engages the gear teeth of the toothed plate. In some embodiments, the motor is operatively coupled to the gear, the motor and the gear being capable of selectively rotating the toothed plate between a first position in which the opening defined by the toothed plate is generally aligned with the lumen defined by the guide and a second position in which the opening defined by the toothed plate is not aligned with the lumen defined by the guide.

A magazine loading apparatus in accordance with some embodiments comprises a wheel, a bowl tray, and an aperture defining element received in a tray opening defined by the bowl tray. The bowl tray defines a lower volume. In some embodiments, the bowl tray is positioned so that an upper edge of the bowl tray meets a lower edge of a bowl wall with the bowl tray and the bowl wall cooperating to define a bowl cavity. The bowl cavity is configured to receive a plurality of cartridges in some embodiments.

A wheel is disposed inside the bowl cavity in some embodiments. In some embodiments, cartridges are circulated upon rotation of the wheel and pass through an aperture defined by the aperture defining element while the cartridges are assuming either a first orientation or a second orientation. A chute body is positioned near the aperture defining element in some embodiments. In some embodiments, the chute body defines a channel. The channel communicates with the aperture and cartridges that have passed through the aperture enter the channel in some embodiments. In some embodiments, the chute body defines a channel exit that communicates with the channel and cartridges that have passed through the channel pass into the channel exit. A guide is positioned near the channel exit in some embodiments. In some embodiments, the guide defines a shaped lumen that communicates with the channel exit defined by the chute body and cartridges that have passed through the channel exit pass into the shaped lumen.

In some embodiments, the magazine loading apparatus includes a sorter for selectively allowing a series of cartridges to exit the shaped lumen defined by the guide. The series of cartridges may include, for example, a first cartridge, a second cartridge, and a third cartridge. In some embodiments, the sorter receives the first cartridge and rotates the first cartridge from the first orientation to the second orientation if the random orientation of the first cartridge is the first orientation. The sorter may also allow passage of the first cartridge without rotation if the random orientation of the first cartridge is the second orientation. The sorter comprising a toothed plate defining an opening in some embodiments.

A magazine loading apparatus in accordance with some embodiments comprises a base and a housing supported by the base. In some embodiments, the housing comprises an outer wall, a bowl wall, and a fillet wall disposed between the outer wall and the bowl wall. The fillet wall and the bowl wall define an upper opening and an upper volume fluidly communicating with the upper opening in some embodiments. The magazine loading apparatus may also include a bowl tray defining a lower volume. In some embodiments, the bowl tray is positioned so that an upper edge of the bowl tray meets a lower edge of the bowl wall. The bowl tray and the bowl wall may cooperate to define a bowl cavity. In some embodiments, an aperture defining element is received in a tray opening defined by the bowl tray. The aperture defining element may defining an aperture that is dimensioned and configured to allow the passage of cartridges therethrough while the cartridges are assuming either a first orientation or a second orientation. The magazine loading apparatus may also include a wheel disposed inside the bowl cavity and a motor operatively coupled to the wheel for rotating the wheel about a first axis. Upon rotation, the wheel may circulates cartridges in the bowl cavity whereby, cartridges circulated by the wheel pass through the aperture defined by the aperture defining element while assuming either a first orientation or a second orientation.

A feature and advantage of embodiments of the motorized device is that cartridges are oriented in a horizontal orientation and are maintained in a horizontal orientation until and as the cartridges are loaded into a magazine. Maintaining the cartridges in a horizontal orientation allows for a mechanized sorter of less height as the cartridge pathway does not include pathways for vertical or upright cartridges. Moreover a magazine receiver receives a magazine in a horizontal orientation thereby maintaining the minimal height of the device.

In embodiments, the circular hopper may have a central dome feature to urge cartridges to the periphery of the bowl. In embodiments, the circular hopper has a wheel with a vertical axis of rotation.

A feature and advantage of embodiments of the invention is that gravity is utilized to transfer the cartridges serially from the pockets of the rotating wheel, through the exit aperture, down a chute, and onto a direction orienting rotatable plate, from a seating position in the plate to a loading region at an entrance to a magazine.

A feature and advantage of embodiments of the invention is that cartridges are directionally oriented using automated means and no relying upon gravity, this can minimize equipment jamming issues and reduce the size, particularly the height of the magazine loaders.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIGS. 11A through 11F may be collectively referred to as FIG. 11.

FIGS. 12A-12C may be collectively referred to as FIG. 12.

FIGS. 13A-13B may be collectively referred to as FIG. 13.

Figure 1:
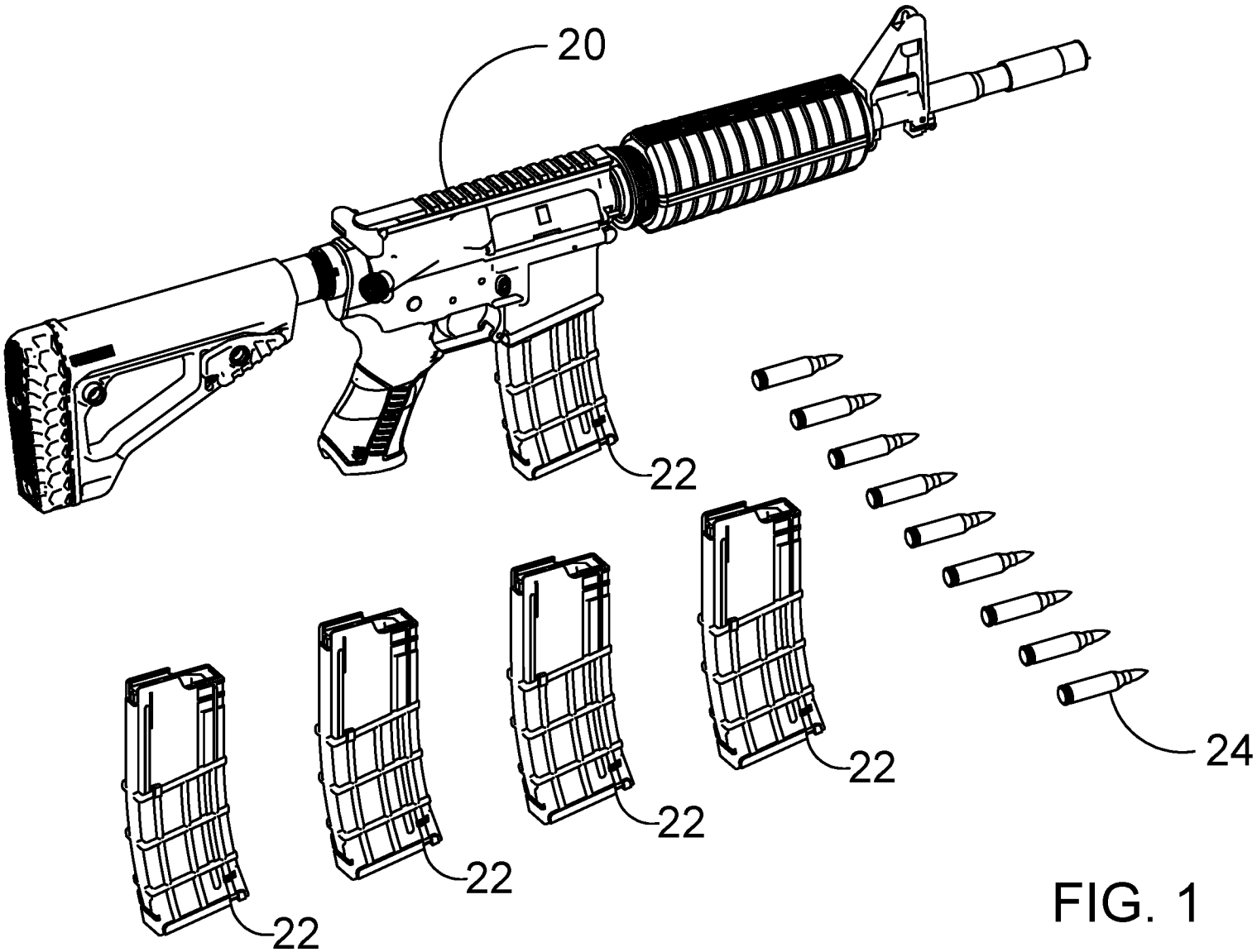
FIG. 1 is a perspective view showing a firearm, a plurality of cartridges and a plurality of magazines for holding cartridges and feeding the cartridges into the firearm.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 2-6, a magazine loader 100 for loading cartridges into a magazine comprises a circular hopper 190 including a bowl portion 168 defining a bowl cavity 122. The circular hopper 190 may include a lifting wheel 126 disposed inside the bowl cavity 122. The lifting wheel 126 may have a drive system and be rotatable about a rotational axis AA, the rotational axis AA being disposed at an acute angle relative to vertical. In embodiments, the lifting wheel 126 defines plurality of cartridge receiving pockets 192, each pocket 192 being configured to receive an individual cartridge in two directional orientations. The bowl portion 168 may define an exit aperture 132 communicating with the bowl cavity 122.

Referring to FIGS. 6-10, in embodiments, the magazine loader 100 includes a chute 140 positioned to receive the series of cartridges exiting the exit aperture 132. In embodiments, the chute is configured to receive and transfer individual cartridges of the series of cartridges in a horizontal orientation and in either of the two directional orientations and to position the series of cartridges above a pivotable plate 150 of a sorter 204. The sorter 204 may comprise the pivotable plate and a drive system 206 for the pivotable plate 150. The pivotable plate 150 may define a shaped opening 152 dimensioned and configured to receive individual cartridges in the two directional rotations. The pivotable plate 150 may be rotatable by the drive system in either of the two directional rotations, clockwise and counterclockwise, for orienting the series of cartridges in a single directional orientation. In embodiments, the sorter 204 has a gravity fed exit slot 166 to a directionally oriented cartridge pathway 142, the pathway 142 extending to a cartridge loading region adjacent a magazine receiver 202. The magazine receiver 202 may be configured to secure a magazine to be loaded therein. A loader mechanism 200 of the magazine loader 100 may be positioned proximate the cartridge loading region 196, the loader mechanism 200 having a powered pusher for horizontally loading individual cartridges in the cartridge loading region 196 into a magazine secured in the magazine receiver 202.

Referring to FIGS. 2-10, in embodiments, a method for loading a plurality of cartridges into a magazine comprises receiving an unordered batch of cartridges within a circular hopper 190 defining a bowl cavity 122. In embodiments, the circular hopper 190 includes a lifting wheel 126 disposed inside the bowl cavity 122 and the lifting wheel 126 rotates about a rotational axis AA that is disposed at an acute angle relative to vertical. The lifting wheel 126 may be rotated so that a series of cartridges are received in a plurality of cartridge receiving pockets 192 defined by the lifting wheel and each cartridge is lifted to an exit aperture 132 defined by a bowl portion 168 of the circular hopper. A series of cartridges may be dropped through the exit aperture 132 and into a chute 140. The series of cartridges may slide down the chute 140 in a horizontal orientation to stack against a pivotable plate 150 of a sorter 204. The pivotable plate 150 may define a shaped opening 152 that is dimensioned and configured to receive an individual cartridge with each individual cartridge assuming a random directional orientation of one of two directional orientations, the random directional orientation being a first directional orientation and an opposite second directional orientation. In embodiments, the method includes determining whether the random directional orientation of each of the series of cartridges received in the shaped opening is the first directional orientation or the second directional orientation. The pivotable plate 150 may be rotated clockwise 90 degrees if the random directional orientation of each of the series of cartridges received in the shaped opening is the first directional orientation and the pivotable plate may be rotated counterclockwise 90 degrees if the random directional orientation of each of the series of cartridges received in the shaped opening is the second directional orientation. Each cartridge may be allowed to fall through an exit slot 166 defined by a stationary plate 158 located below the pivotable plate 150 so that each cartridge drops into the cartridge loading region 196 of a loader mechanism 200 whereby each cartridge is directionally oriented in the same direction. Each of the series of cartridges may be pressed into a captured magazine by a pusher of the loader mechanism 200.

Referring to FIGS. 8-10 and 14-17, a magazine loader 100 in accordance with this detailed description may comprise circuitry 170 operatively coupled to a sorter motor 156, a lifting wheel motor 260, and a plurality of sensors 186, 188. In embodiments, the magazine loader 100 includes a printed wiring board 172 supporting the circuitry 170. In embodiments, the printed wiring board 172 comprises a substrate 174 and the substrate 174 supports a plurality of conductive paths 176 of the circuitry 170. In the example embodiment shown in the figures, the circuitry 170 comprises the printed wiring board 172 and a plurality of electronic components that are electrically connected to the conductive paths 176 of the printed wiring board 172. The plurality of electronic components are mechanically fixed and/or electrically connected to the printed wiring board 172 to form a circuit card assembly.

Still referring to FIGS. 8-10 and 14-17, the circuitry 170 may comprise various elements without deviating from the spirit and scope of the present invention. For example, the circuitry may comprise combinational logic, a plurality of state machines and a clock that provides a clock signal to the combinational logic and the plurality of state machines. Each state machine may comprise state logic circuitry and a state memory. The state memory may comprise a plurality of memory elements such as flip-flops. The state logic circuitry of the state machine determines the conditions for changing the logical values of bits stored in the state memory. More particularly, the state logic circuitry of the state machine logically combines the binary values of a plurality of inputs with the binary values in the state memory representing the current state to generate a binary number representing the next state. The combinational logic circuitry may comprise various elements without deviating from the spirit and scope of the present description. For example, the combinational logic circuitry may comprise a plurality of discrete electronic components. By way of a second example, combinational logic circuitry may comprise a plurality of electronic components in the form of an application specific integrated circuit (ASIC). Examples of electronic components that may be suitable in some applications include logic gates. Examples of logic gates include, AND gates, NAND gates, OR gates, XOR gates, NOR gates, NOT gates, and the like. These logic gates may comprise a plurality of transistors (e.g., transistor-transistor logic (TTL)).

Still referring to FIGS. 8-10 and 14-17, the circuitry 170 may comprise various control elements without deviating from the spirit and scope of the present invention. In one or more embodiments, for example, the circuitry 170 may comprise a processor 178, a memory 180, an input/output interface, a display, and a bus that communicatively couples the processor 178 to the memory, the display and the input/output interface. In an embodiment, the processor 178 may comprise a collection of one or more logical cores or units for receiving and executing instructions or programs. For example, in one or more embodiments, the processor 178 may be configured to receive and execute various routines, programs, objects, components, logic, data structures, and so on to perform particular tasks. In an embodiment, the memory is a collection of various computer-readable media in the system architecture. In various embodiments, memory 180 can include, but is not limited to volatile media, non-volatile media, removable media, and non-removable media. For example, in one or more embodiments, the memory 180 can include random access memory (RAM), cache memory, read only memory (ROM), flash memory, solid state memory, or other suitable type of memory. In one or more embodiments, the memory includes media that is accessible to the electronic circuitry 170. For example, in some embodiments, the memory includes computer readable media located locally in the circuitry 170 and/or media located remotely to the circuitry 170 and accessible via a network. In some embodiments, the memory includes a program product having a group of one or more logical instructions that are executable by the processor 178 to carry out the functions of the various embodiments of the disclosure. In an embodiment, the bus comprises one or more of any of suitable type of bus structures for communicatively connecting the electronic elements. In various embodiments the bus may include a memory bus or memory controller, a peripheral bus, and a processor 178 or local bus using any of a variety of bus architectures. In some embodiments, the circuitry 170 includes an I/O interface 188 coupled to a processor 178. The I/O interface 188 may facilitate communication between the various components and the circuitry 170. For example, in one or more embodiments, the I/O interface 188 may be communicatively coupled with one or more sensors. In certain embodiments the I/O interface 188 facilitates communication with input and output devices for interacting with a user. For example, the I/O interface 188 may communicate with one or more devices such, as a user-input device and/or a visual display 182, which enable a user to interact directly with the circuitry 170. The user-input device may comprise a keypad 184, one or more push buttons 186, a touch screen, or other devices that allows a user to input information. The visual display 182 may comprise any of a variety of visual displays, such as a viewable screen, a set of viewable symbols or numbers, and so on.

Referring to FIGS. 8-10 and 14-17, a magazine loader 100 in accordance with this detailed description may comprise circuitry 170 operatively coupled to a first cartridge tip detector 286 and a second cartridge tip detector 288. The first cartridge tip detector 286 may be positioned such that the first cartridge tip detector 286 detects the presence of a cartridge tip portion while a particular cartridge is received in the shaped opening 152 and the particular cartridge is assuming the first directional orientation. The second cartridge tip detector 288 may be positioned such that the second cartridge tip detector 288 detects the presence of a cartridge tip portion while a given cartridge is received in the shaped opening 152 defined by the pivotable plate and the given cartridge is assuming the second directional orientation. Each cartridge tip detector comprises a light source 256 and a light sensor 258. The light source 256 and the light sensor 258 may be positioned such that light emitting from the light source 256 illuminates a portion of the cartridge tip and the light sensor 258 provides a signal responsive to light reflected off of the cartridge tip when the cartridge tip is in the closed position. In embodiments, the light source 256 comprises a light emitting diode (LED) and the light sensor 258 comprises a phototransistor. In embodiments other sensors, such as capacitive or inductive sensors may be used. In embodiment mechanical micro switches may be used as the sensor.

Referring to FIGS. 8-10 and 14-17, a magazine loader 100 for loading cartridges into a magazine, comprises a bowl portion 168 defining a bowl cavity 122 configured to receive a plurality of cartridges. In embodiments, a rotatable lifting wheel 126 of the magazine loader is disposed inside the bowl cavity 122. The lifting wheel 126 may be capable of circulating cartridges in the bowl upon rotation thereof. A chute 140 of the magazine loader 100 may be positioned with a chute entry at an upper region of the bowl. The chute entry may be dimensioned and configured to allow passage of individual cartridges generally in a horizontal orientation there through while each cartridge is assuming a random directional orientation of one of two directional orientations, the random directional orientation being a first directional orientation or a second directional orientation, the first directional orientation being opposite the second directional orientation. A chute body 140 may define a channel 142, the channel 142 communicating with the aperture 132, wherein cartridges that have passed through the chute entry pass down the channel 142 in a horizontal orientation. The chute body 140 may defines a channel exit 134, the channel exit 134 communicating with the channel 142, wherein cartridges that have passed through the channel 142 pass out the channel exit 134 in a horizontal orientation. The sorter 204 may comprise a feed guide 144 defining a shaped passageway 146. The shaped passageway 146 may communicate with the channel exit 134 defined by the chute body 140, wherein cartridges that have passed through the channel exit 134 pass into the shaped passageway 146 and seat therein in a horizontal orientation and in either of two directional orientations. The sorter 204 may further comprise a pivotable plate 150 positioned below the feed guide 144. The sorter 204 may have a directional orientation detector and the pivotable plate 150 may receive a cartridge from the feed guide 144 and, depending on orientation, may rotate the pivotable plate 150 to orient the cartridges in a common directional orientation and discharge the cartridges to a loader mechanism 200 opposite a magazine receiver 202 for pushing the horizontal cartridges into a magazine secured by the magazine receiver.

Figure 2:
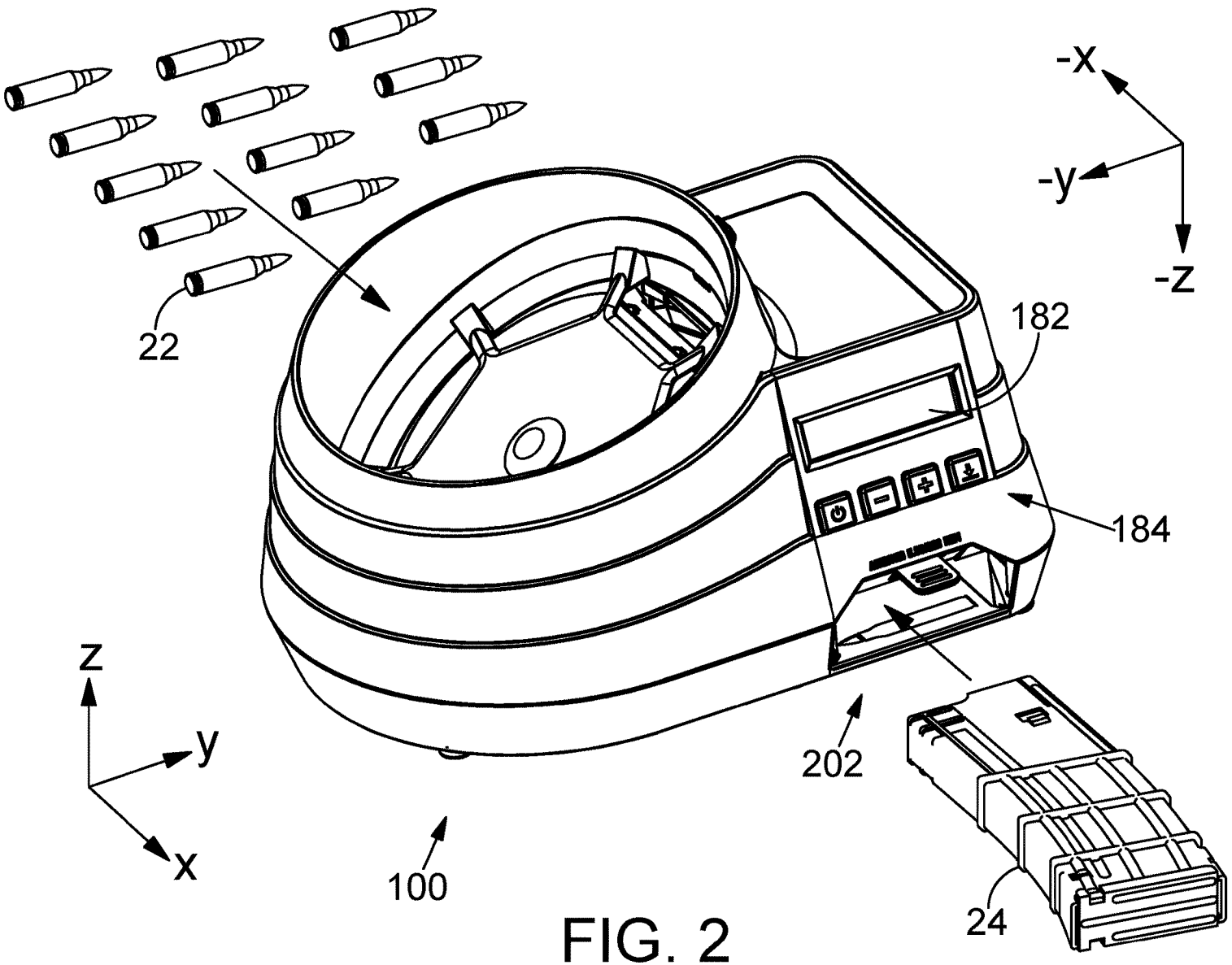
FIG. 2 is a perspective view showing a plurality of magazines, a plurality of cartridges and a magazine loader for loading cartridges into the magazines.

Referring to FIG. 1, a perspective view showing a firearm 20, a plurality of cartridges 24 and a plurality of magazines 22 for holding cartridges 24 and feeding the cartridges into the firearm 20 is presented. FIG. 2 is a perspective view showing a plurality of magazines 22, a plurality of cartridges 24 and a magazine loader 100 for loading cartridges 24 into the magazines 22.

Figure 3:
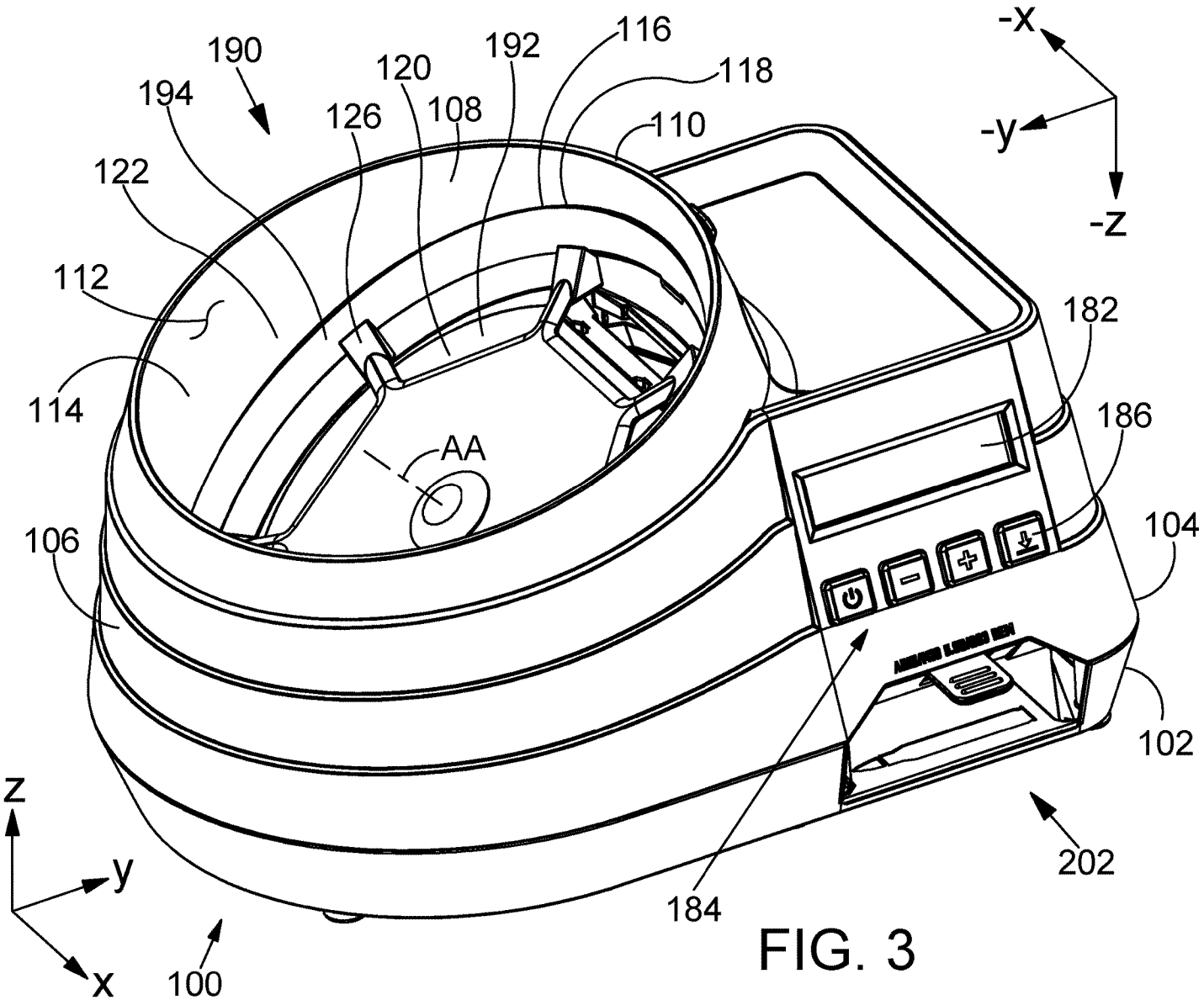
FIG. 3 is perspective views of a magazine loader in accordance with the detailed description.

Referring to FIG. 3 a perspective view of a magazine loader 100 is shown. The magazine loader 100 of FIG. 3 includes a base 102 and a housing 104. The housing 104 comprises an outer wall 106, a bowl wall 108, and a fillet wall 110 disposed between the outer wall 106 and the bowl wall 108. The fillet wall 110 and the bowl wall 108 define an upper opening 112 and an upper volume 114 fluidly communicating with the upper opening 112. A lower edge 116 of the bowl wall 108 meets an upper edge 118 of the bowl tray 120. The bowl tray 120 and the bowl wall 108 cooperate to define a bowl cavity 122. The bowl tray 120 defines a lower volume 194 of the bowl cavity 122. A wheel 126 is disposed inside the bowl cavity 122. A motor is operatively coupled to the wheel 126 for rotating the wheel about a first axis AA.

In FIG. 3, an upward direction Z and a downward or lower direction −Z are illustrated using arrows labeled "Z" and "−Z," respectively. A forward direction Y and a rearward direction −Y are illustrated using arrows labeled "Y" and "−Y," respectively, in FIG. 3. Also, a starboard direction X and a port direction −X are illustrated using arrows labeled "X" and "−X," respectively. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims. The port direction may also be referred to as the portward direction. The upward direction may be generally opposite the downward direction. The upward direction and the downward direction may both be generally orthogonal to an XY plane defined by the forward direction and the starboard direction. The forward direction may be generally opposite the rearward direction. The forward direction and the rearward direction may both be generally orthogonal to a ZY plane defined by the upward direction and the starboard direction. The starboard direction may be generally opposite the port direction. The starboard direction and the port direction may both be generally orthogonal to a ZX plane defined by the upward direction and the forward direction. The directions illustrated using these arrows (e.g., arrows X, Y and Z) are applicable to the apparatus shown and discussed throughout this application. These arrows are also shown, for example, in FIG. 2 and FIGS. 6-9.

Figure 4:
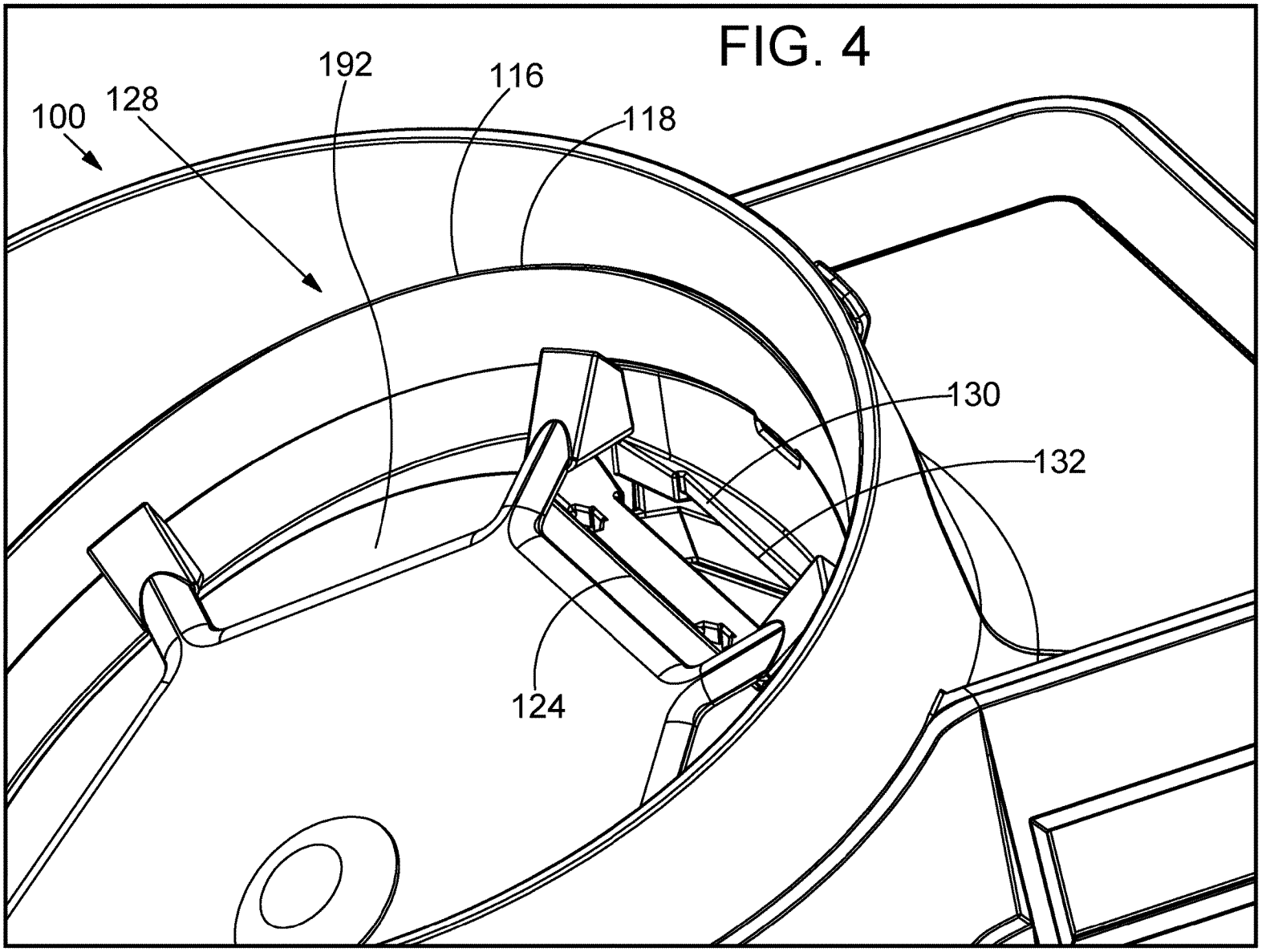
FIG. 4 is an enlarged perspective view further illustrating a portion of the magazine loader shown in FIG. 3.

Referring to FIG. 4 an enlarged perspective view further illustrating a portion of the magazine loader 100 shown in FIG. 3 is presented. With reference to FIG. 4, it will be appreciated that the bowl tray 120 defines a tray opening 124. In the embodiment of FIG. 3, the bowl tray 120 is part of a bowl assembly 128. The bowl assembly 128 also includes an aperture defining element 130 that is received in the tray opening 124 defined by the bowl tray 120. The aperture defining element 130 defines an aperture 132.

Figure 5A:
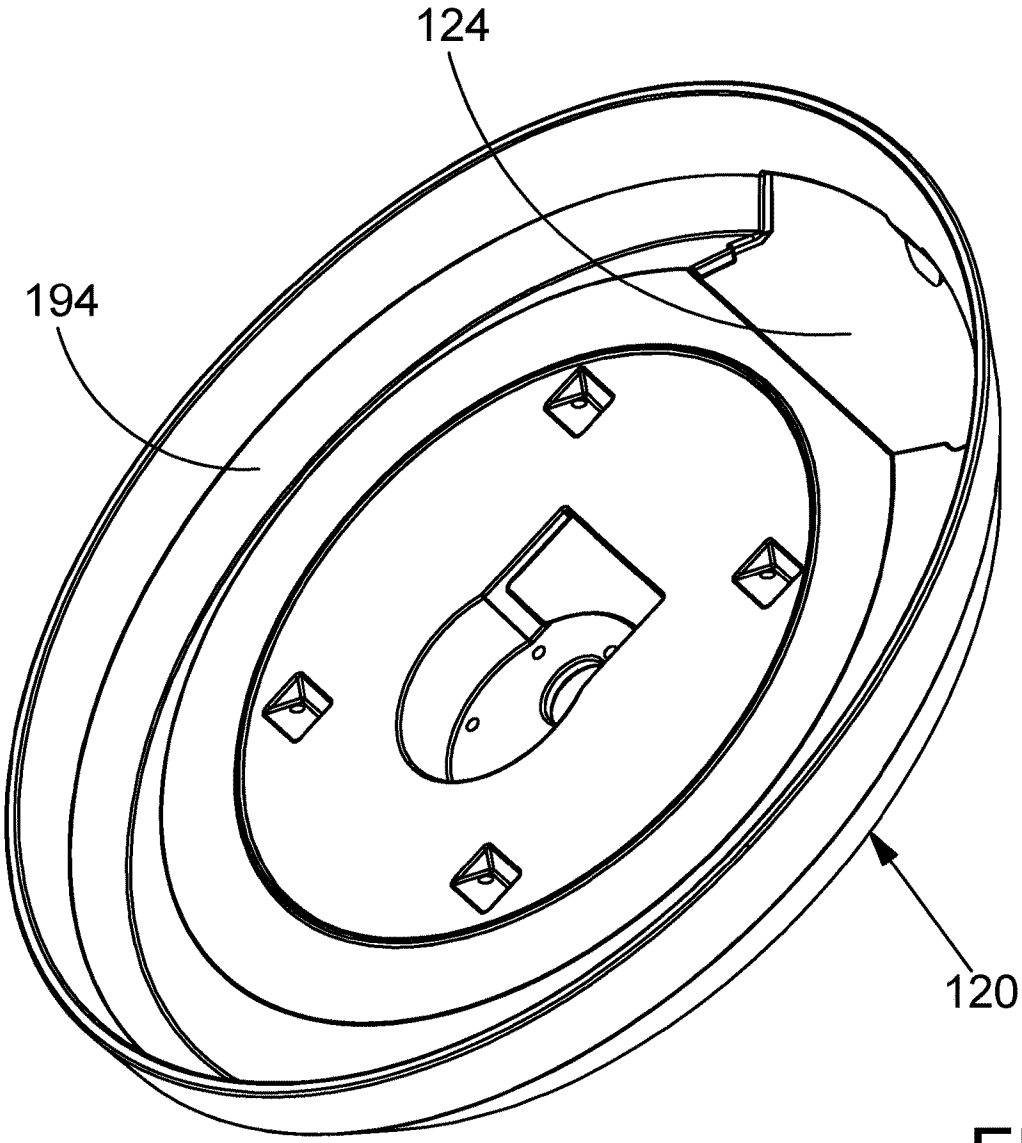
FIG. 5A is a perspective view further illustrating the bowl tray shown in FIG. 4.

Referring to FIG. 5A a perspective view further illustrating the bowl tray 120 shown in FIG. 4 is presented. The bowl tray 120 defines a tray opening 124 that is dimensioned and configured to receive the aperture defining element 130 shown in FIG. 5B. With reference to FIG. 5A, it will be appreciated that the bowl tray 120 also defines a lower volume 194.

Figure 5B:
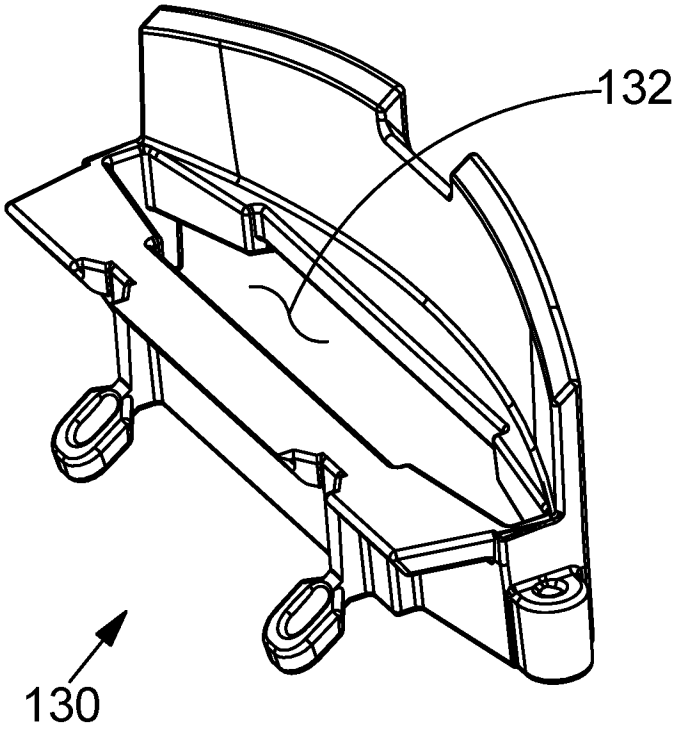
FIG. 5B is a perspective view further illustrating the aperture defining element shown in FIG. 4.

Referring to FIG. 5B a perspective view further illustrating the aperture defining element 130 shown in FIG. 4 is presented. In some useful embodiments, the aperture 132 defined by the aperture defining element 130 is dimensioned and configured to allow the passage of a cartridge therethrough. In some useful embodiments, the first orientation and the second orientation are oriented approximately 180 degrees from one another. In some useful embodiments, a first half of the aperture 132 and a second half of the aperture 132 have shapes that are mirror images of one another.

Figure 6:
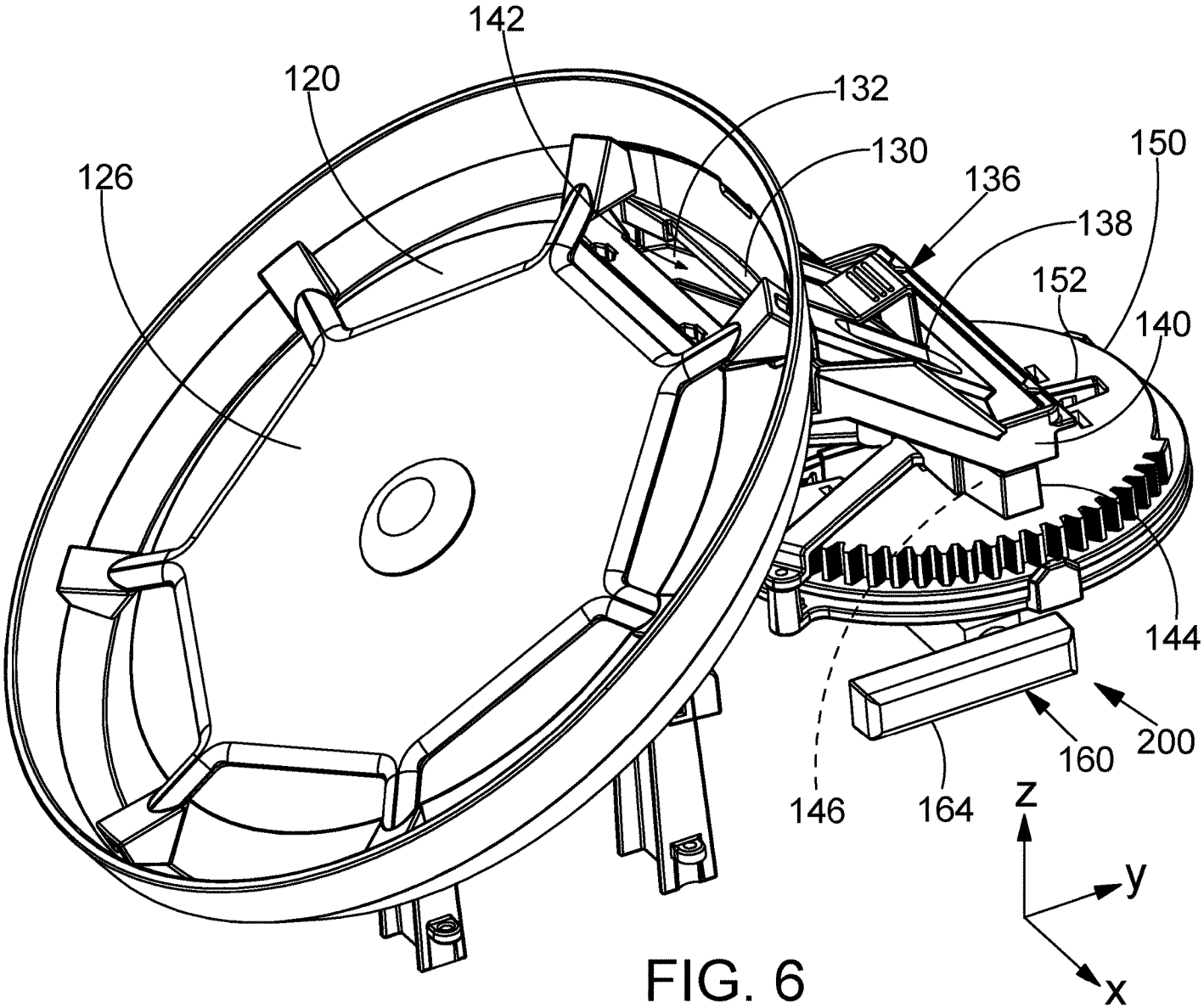
FIG. 6 is a perspective view showing an assembly including the aperture defining element, the bowl tray, and the wheel shown in FIGS. 1 and 2.

Referring to FIG. 6 a perspective view showing an assembly including the aperture defining element 130, the bowl tray 120, and the wheel 126 shown in FIGS. 1 and 2 is presented. The assembly of FIG. 6 also includes a chute assembly 136 comprising a chute body 140 and a chute lid 138. The chute body 140 defines a channel 142 and the chute lid 138 is positioned to cover the channel 142 in the assembly of FIG. 6. The assembly of FIG. 6 also includes a guide 144 and a toothed plate 150.

Figure 7:
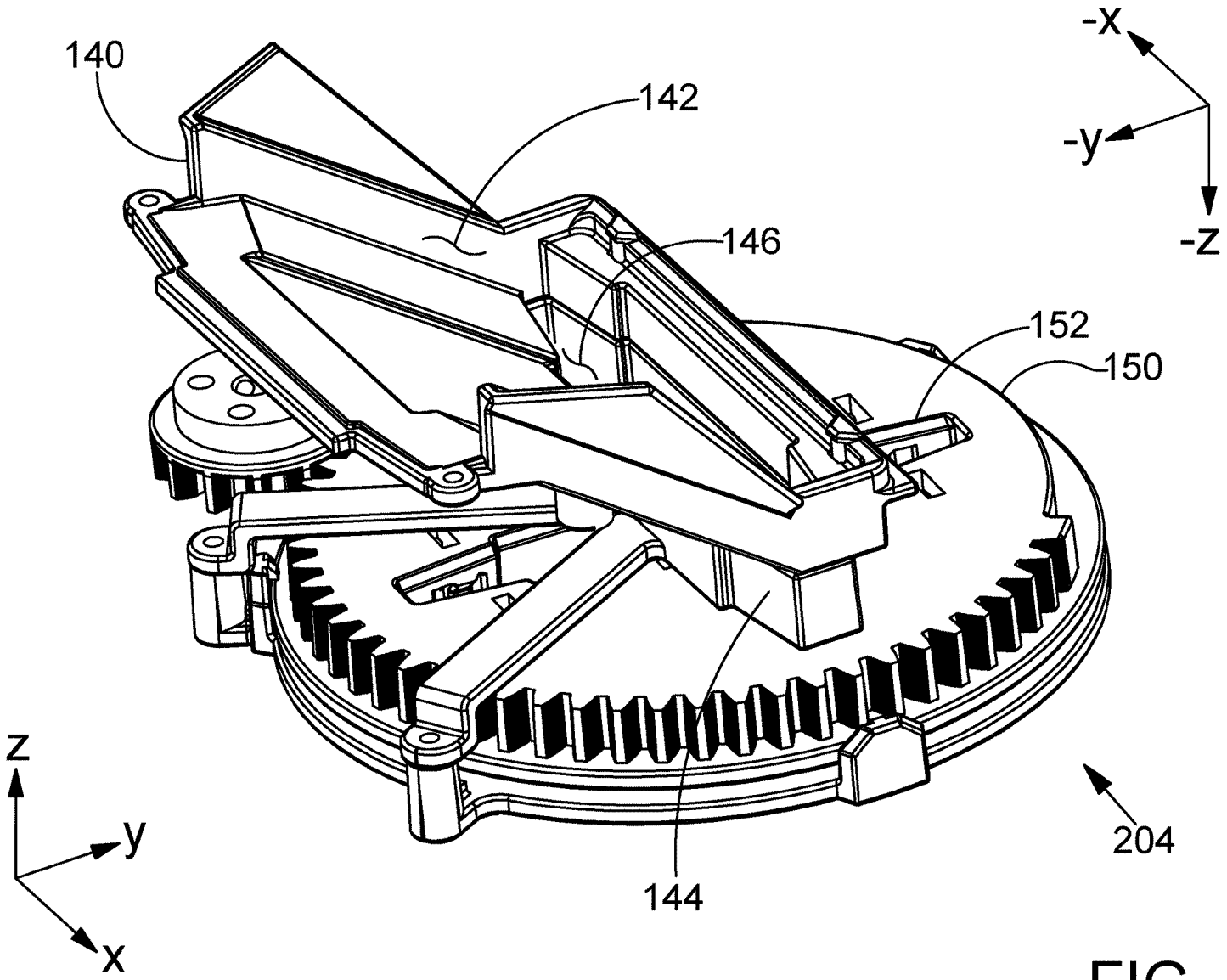
FIG. 7 is a perspective view showing an assembly including the guide and the toothed plate shown in FIG. 6.

Referring to FIG. 7 a perspective view showing an assembly including the guide 144 and the toothed plate 150 shown in FIG. 6 is presented. The toothed plate 150 defines an opening 152 and the guide 144 defines a lumen 146 having a shape similar to the shape of the opening 152 defined by the toothed plate 150. The assembly of FIG. 7 also includes a chute body 140 that defines a channel 142. In the embodiment of FIG. 7, the channel 142 communicates with the aperture 132 defined by the aperture defining element 130. The channel 142 also communicates with the lumen 146 defined by the guide 144. The lumen 146 communicates with the opening 152 defined by the toothed plate 150.

Figure 8:
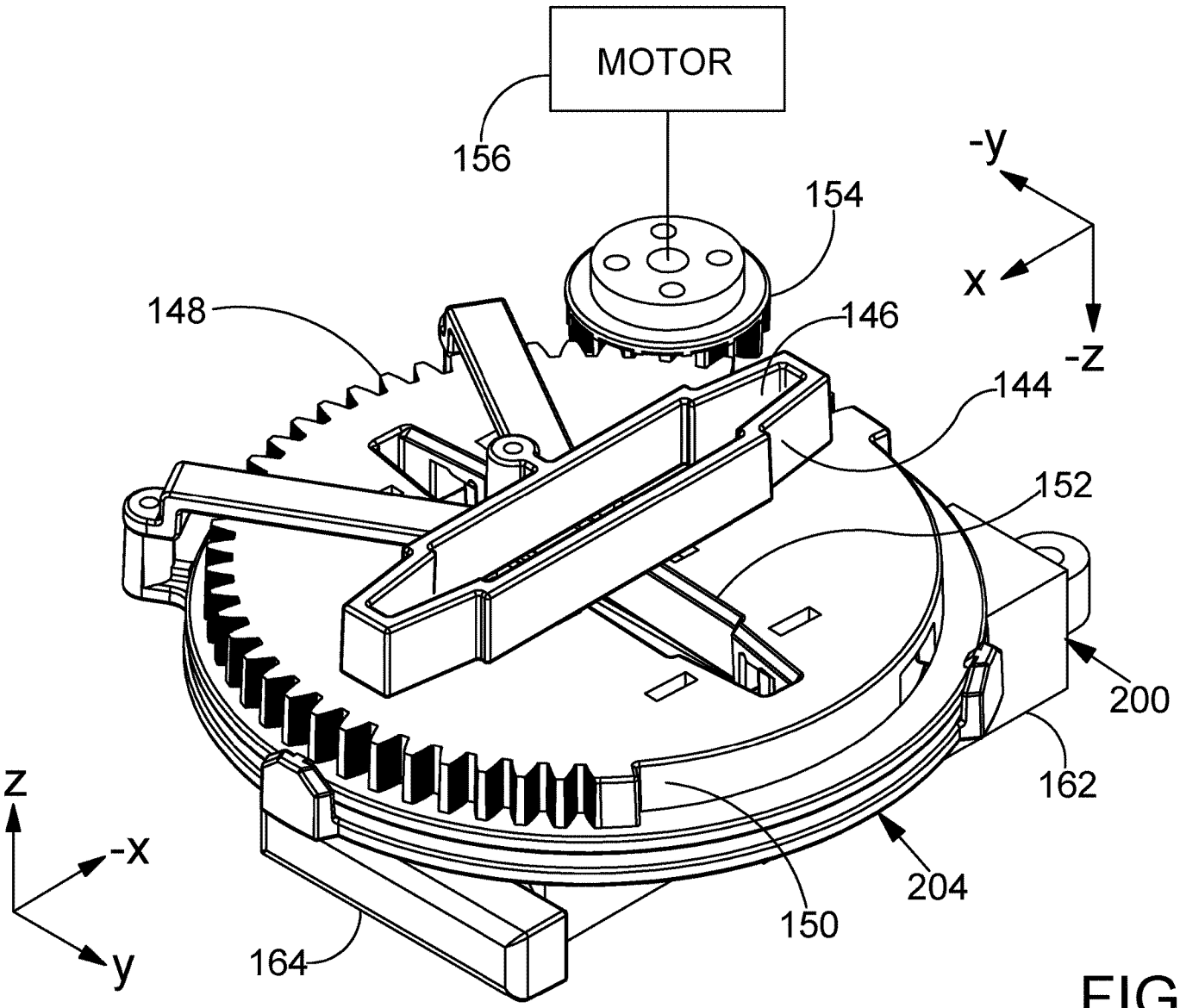
FIG. 8 is a top perspective view showing an assembly including the guide and the toothed plate shown in FIG. 7.

Referring to FIG. 8 a top perspective view showing an assembly including the guide 144 and the toothed plate 150 shown in FIG. 7 is presented. With reference to FIG. 7, it will be appreciated that the toothed plate 150 includes a plurality of gear teeth 148. In FIG. 7, a gear 154 is shown engaging the gear teeth 148 of the toothed plate 150. A motor 156 is operatively coupled to the gear 154. The motor 156 and the gear 154 are capable of selectively rotating the toothed plate 150 to one or more orientations in which the opening 152 defined by the toothed plate 150 is generally aligned with the lumen 146 defined by the guide 144. The motor 156 and the gear 154 are also capable of selectively rotating the toothed plate 150 between a first orientation and a second orientation. In some useful embodiments, the first orientation and the second orientation are oriented approximately 180 degrees from one another. In the embodiment of FIG. 8, a shroud 158 is positioned below the toothed plate 150.

Figure 9:
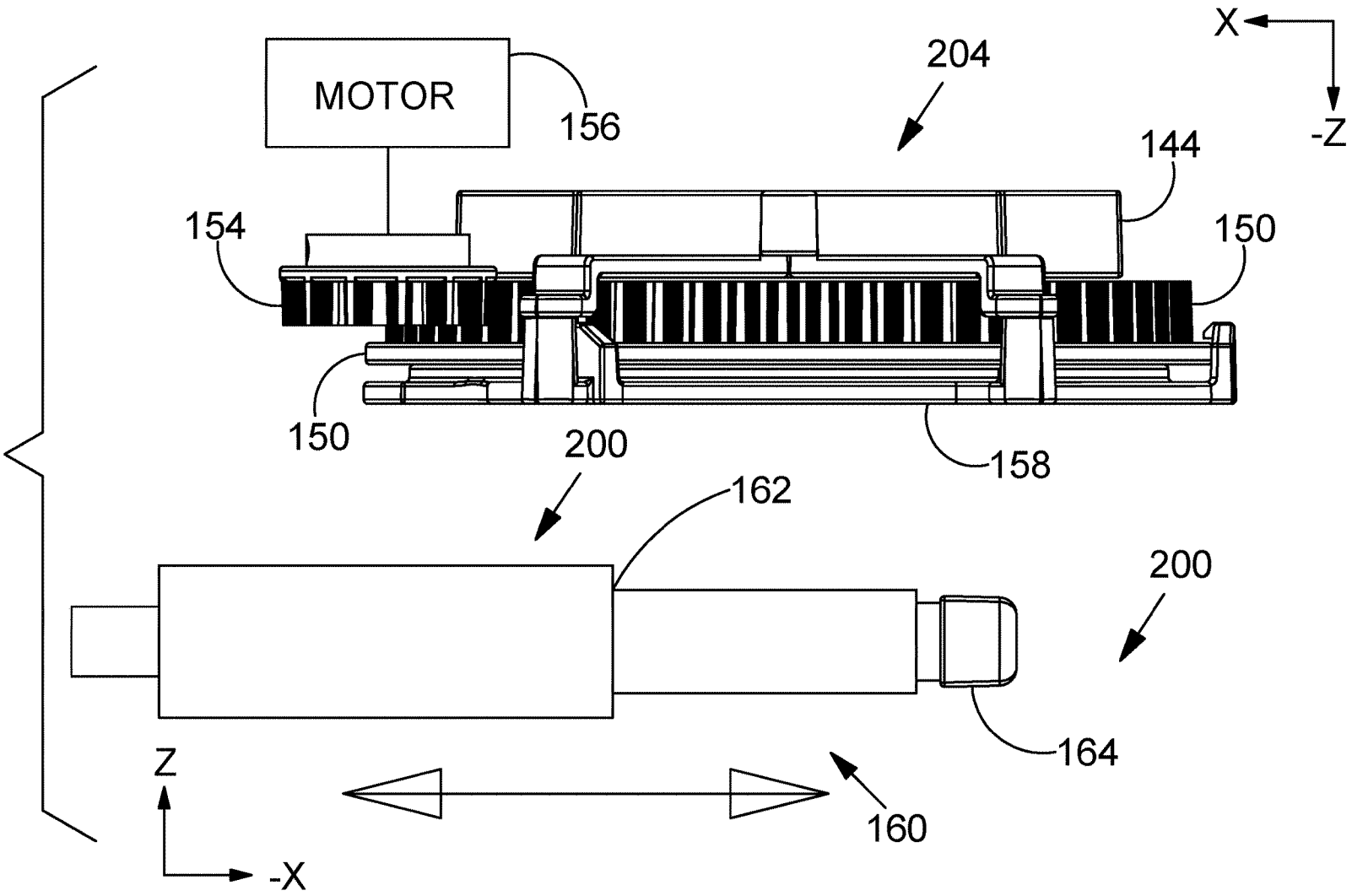
FIG. 9 is a side view further illustrating the assembly shown in FIG. 8. In the embodiment of FIGS. 8 and 9, a linear actuator assembly is disposed below the shroud.

FIG. 9 a side view further illustrating the assembly shown in FIG. 8 is presented. In the embodiment of FIGS. 8 and 9, a linear actuator assembly 160 is disposed below the shroud 158. The linear actuator assembly 160 includes a linear actuator 162 and a head 164. In some useful embodiments, linear actuator assembly 160 is capable of urging linear movement of a cartridge in selected direction.

Figure 10:
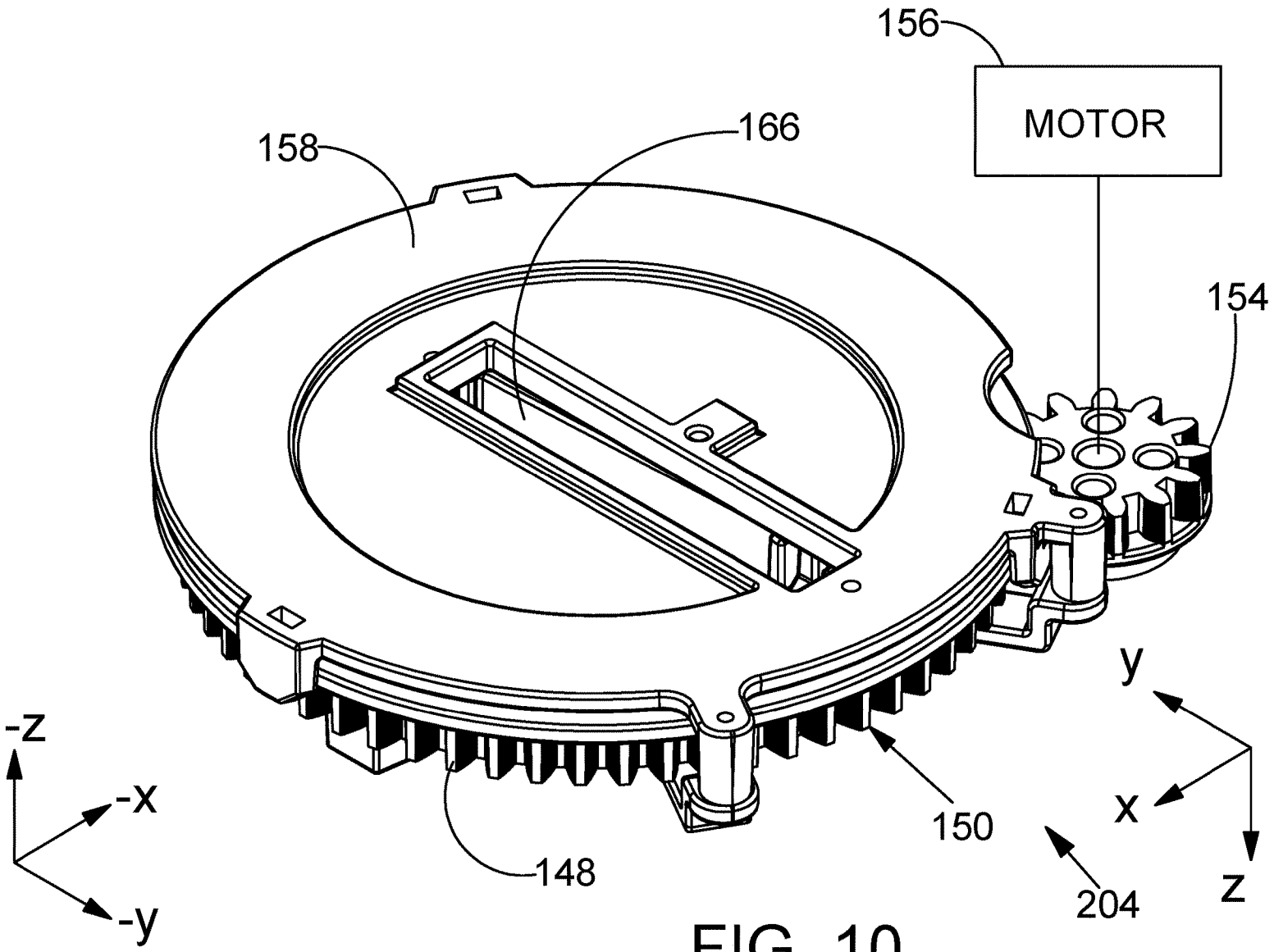
FIG. 10 is a bottom perspective view showing an assembly including the shroud and the toothed plate shown in FIGS. 8 and 9.
Figures 11A, 11B, 11C:
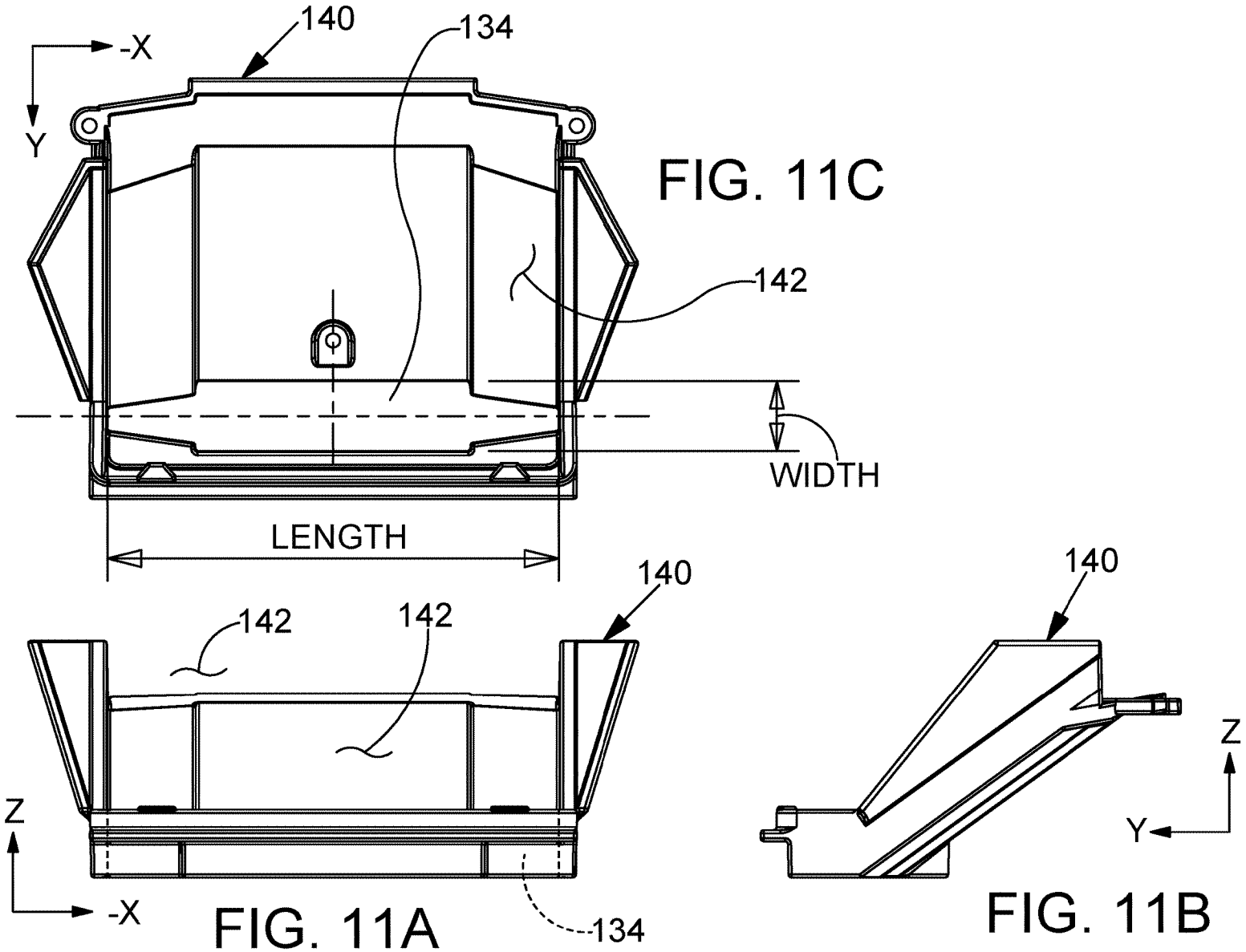
FIG. 11A is a front view of a chute body for a magazine loader in accordance with detailed description.
FIG. 11B is a right side view of the chute body shown in FIG. 11A.
FIG. 11C is a top view of the chute body shown in FIG. 11A.
Figure 11E:
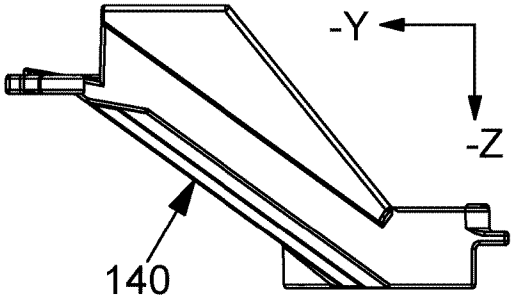
FIG. 11E is a left side view of the chute body shown in FIG. 11A.
Figure 11D:
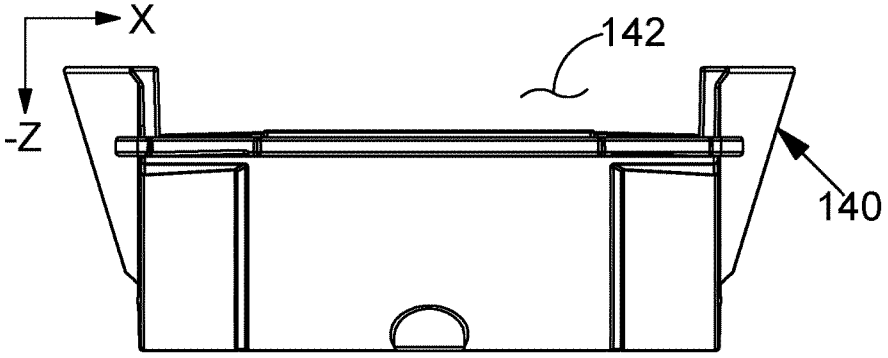
FIG. 11D is a rear view of the chute body shown in FIG. 11A.
Figure 11F:
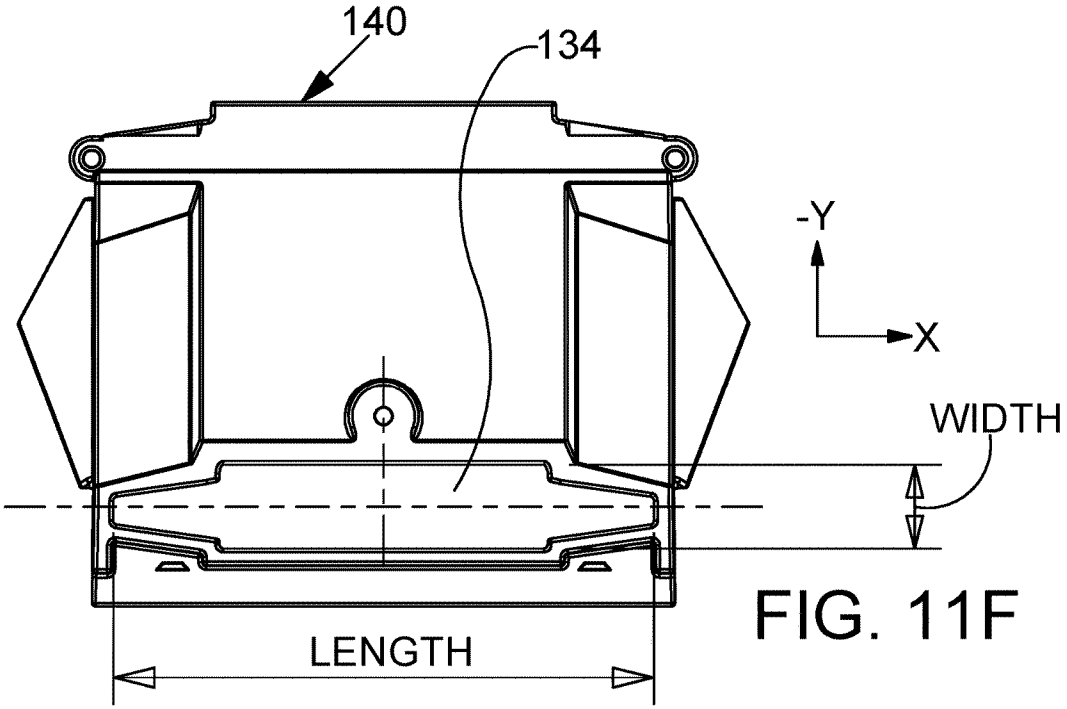
FIG. 11F is a bottom view of the chute body shown in FIG. 11A.

Referring to FIG. 10 a bottom perspective view showing an assembly including the shroud 158 and the toothed plate 150 shown in FIGS. 8 and 9 is presented. With reference to FIG. 10, it will be appreciated that the shroud 158 defines a hole 166. The toothed plate 150 has a plurality of gear teeth 148. In FIG. 10, a gear 154 is shown engaging the gear teeth 148 of the toothed plate 150. A motor 156 is operatively coupled to the gear 154. The motor 156 and the gear 154 are capable of selectively rotating the toothed plate 150 to one or more orientations in which the opening 152 defined by the toothed plate 150 is generally aligned with the hole 166 defined by the shroud 158. The motor 156 and the gear 154 are capable of selectively rotating the toothed plate 150 between a first orientation and a second orientation. In some useful embodiments, the first orientation and the second orientation are oriented approximately 180 degrees from one another Referring to FIG. 11A through FIG. 11F elevation and plan views showing six sides of the chute body 140 are presented. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 11A may be referred to as a front view of the chute body 140, FIG. 11B may be referred to as a right side view of the chute body 140, and FIG. 11C may be referred to as a top view of the chute body 140. FIG. 11A through FIG. 11F may be referred to collectively as FIG. 11. Terms such as front view and right side view are used herein as a convenient method for differentiating between the views shown in FIG. 11. It will be appreciated that the elements shown in FIG. 11 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 11D may be referred to as a rear view of the chute body 140, FIG. 11E may be referred to as a left side view of the chute body 140, and FIG. 11F may be referred to as a bottom view of the chute body 140.

With reference to FIG. 11, it will be appreciated that the chute body 140 defines a channel 142 and a channel exit 134 that communicates with the channel 142. In the embodiment of FIG. 11, the channel exit 134 has a length, a width and a height. The length of the channel exit 134 extends in a portward direction and a starboard direction. The width of the channel exit 134 extends in a forward direction and a rearward direction. The height of the channel exit 134 extends in an upward direction and a downward direction.

Figures 12A, 12B, 12C:
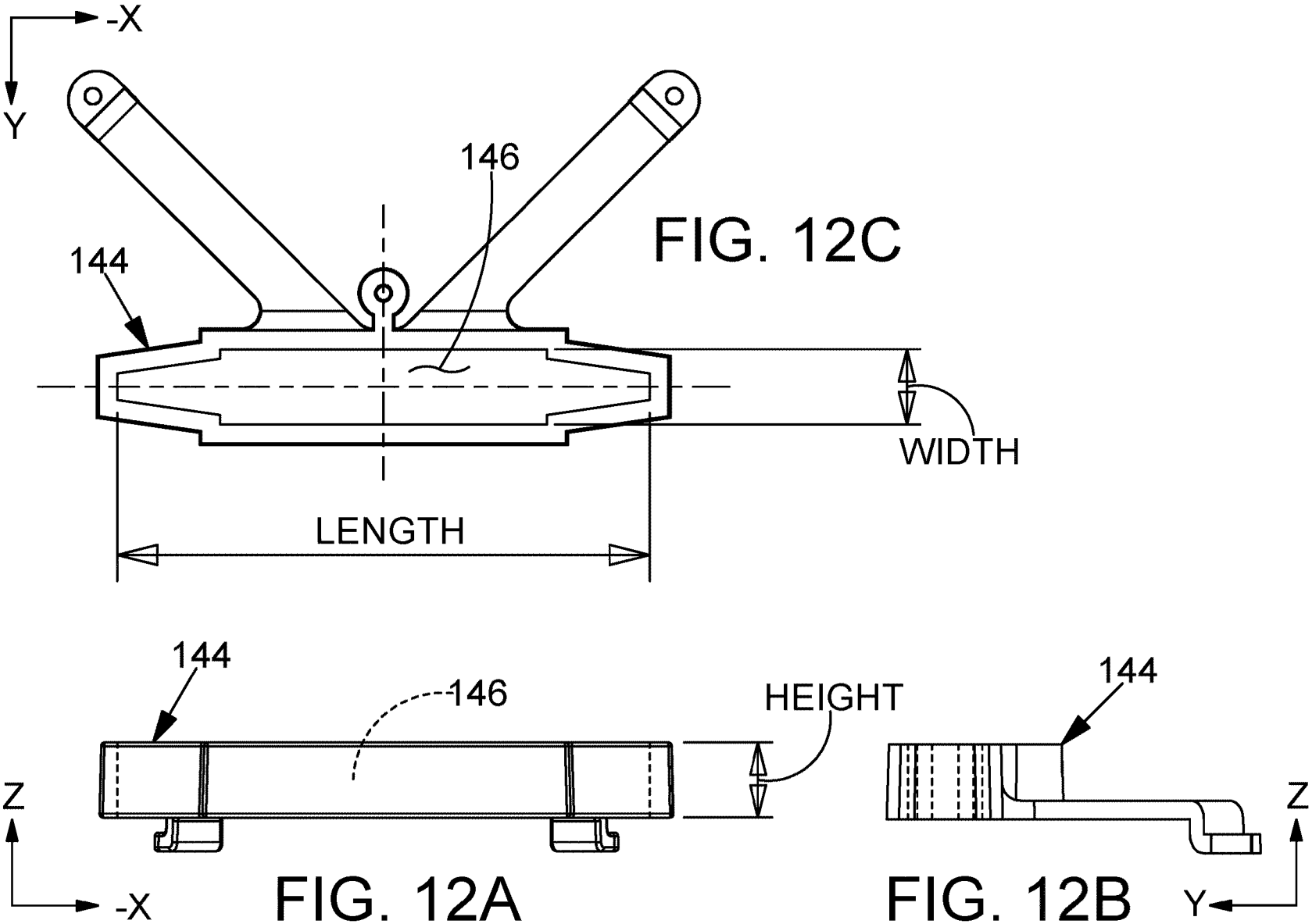
FIG. 12A is a front view showing a guide that defines a lumen having a shape similar to the shape of a channel exit defined by the chute body shown in FIG. 11.
FIG. 12B is a right side view of the guide and FIG. 12C is a top view of the guide.

Referring to FIG. 12A a front view is presented, the front view showing a guide 144 that defines a lumen 146 having a shape similar to the shape of the channel exit 134 defined by the chute body 140 shown in FIG. 11. FIG. 12B is a right side view of the guide 144 and FIG. 12C is a top view of the guide 144. FIGS. 12A-12C may be collectively referred to as FIG. 12. In the embodiment of FIG. 12, the lumen 146 has a length, a width and a height. The length of the lumen 146 extends in a portward direction and a starboard direction. The width of the lumen 146 extends in a forward direction and a rearward direction. The height of the lumen 146 extends in an upward direction and a downward direction.

Figures 13A, 13B, 13C:
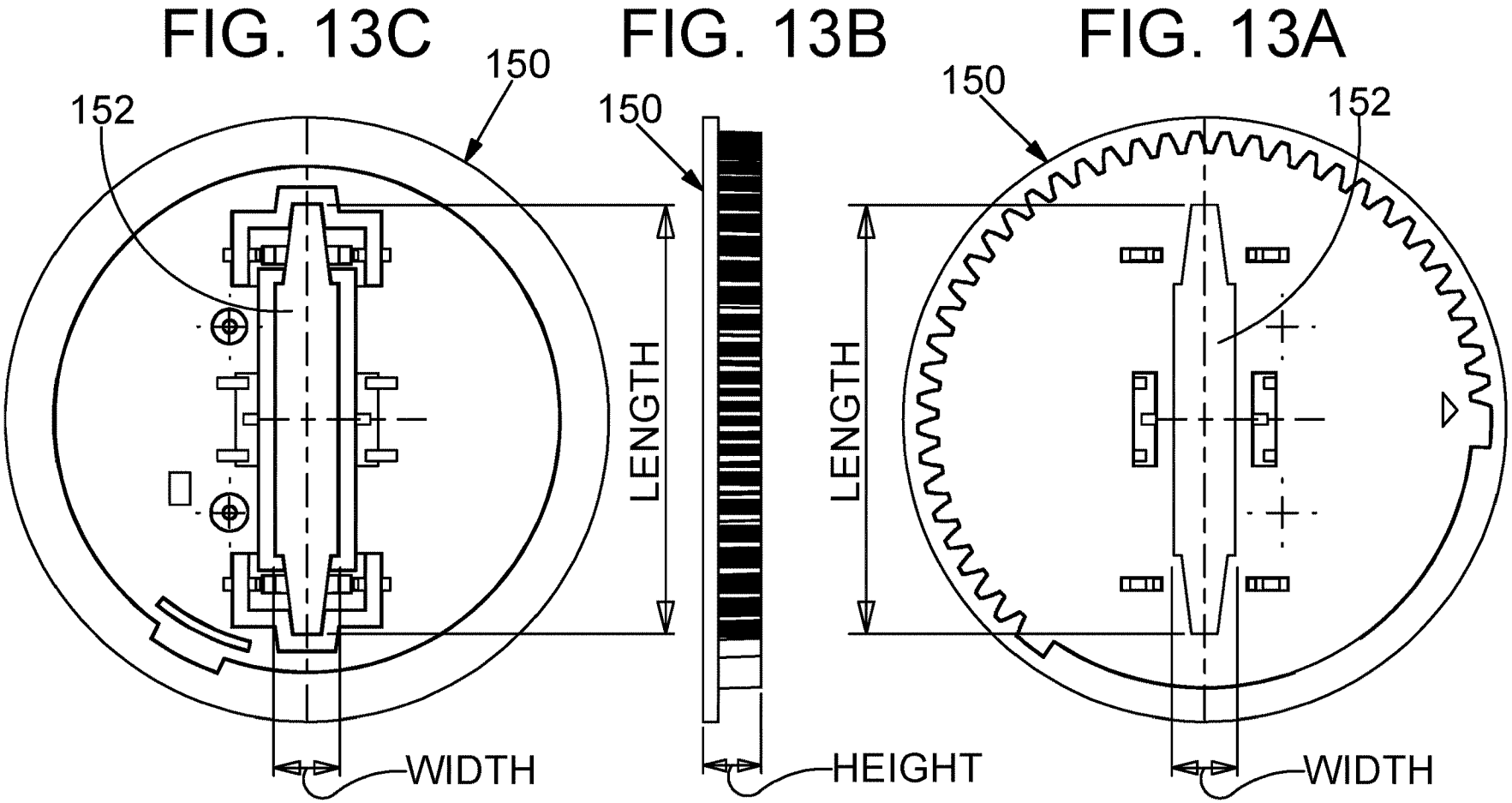
FIG. 13A is a top view showing a toothed plate that defines an opening having a shape similar to the shape of the channel exit defined by the chute body shown in FIG. 11 and the lumen defined by the guide shown in FIG. 12.
FIG. 13B is an elevation view of the toothed plate and FIG. 13C is a top view of the toothed plate.
Figure 14:
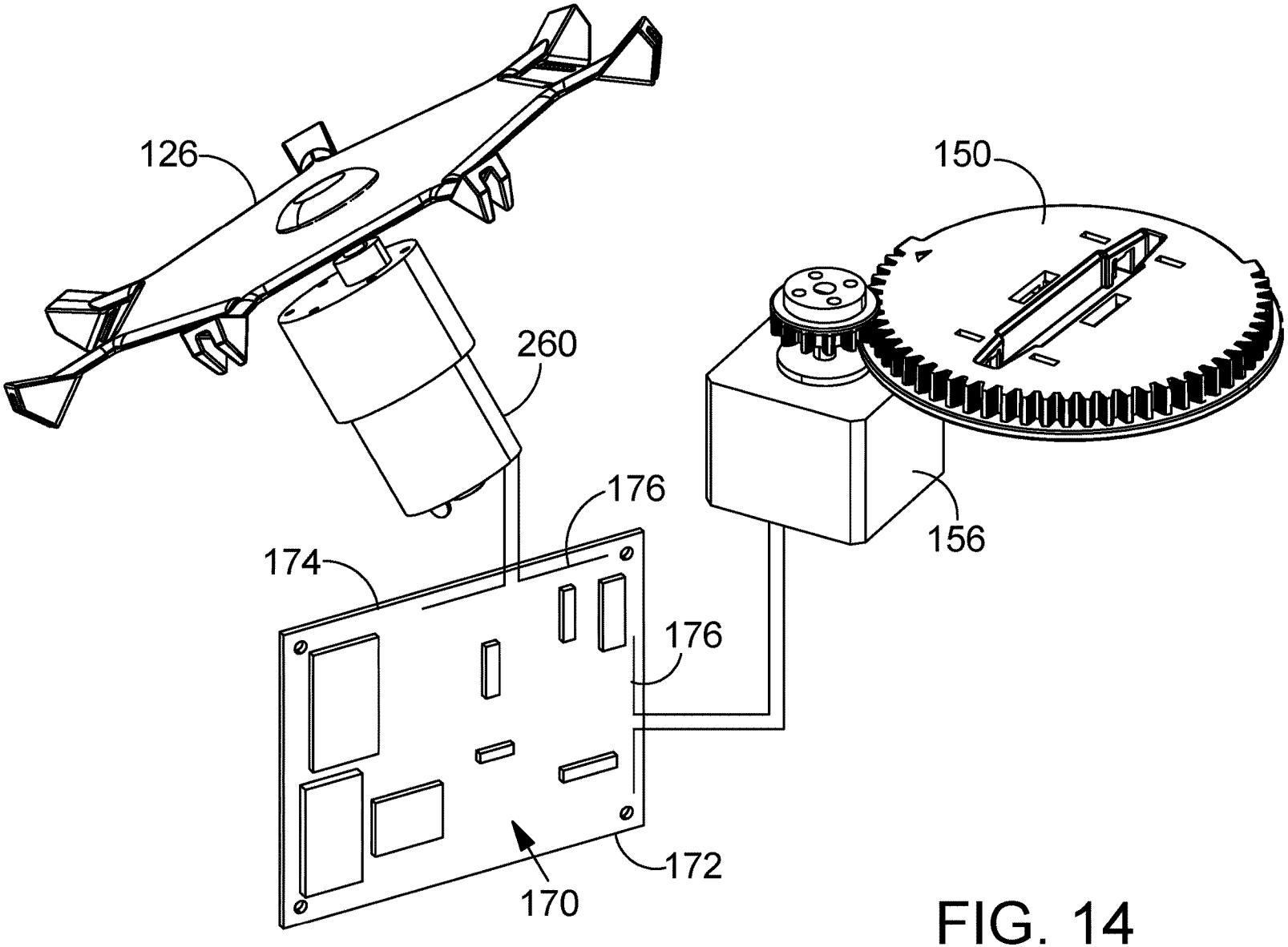
FIG. 14 is a stylized perspective view showing circuitry operatively coupled to a lifting wheel motor and a sorter motor.
Figure 15:
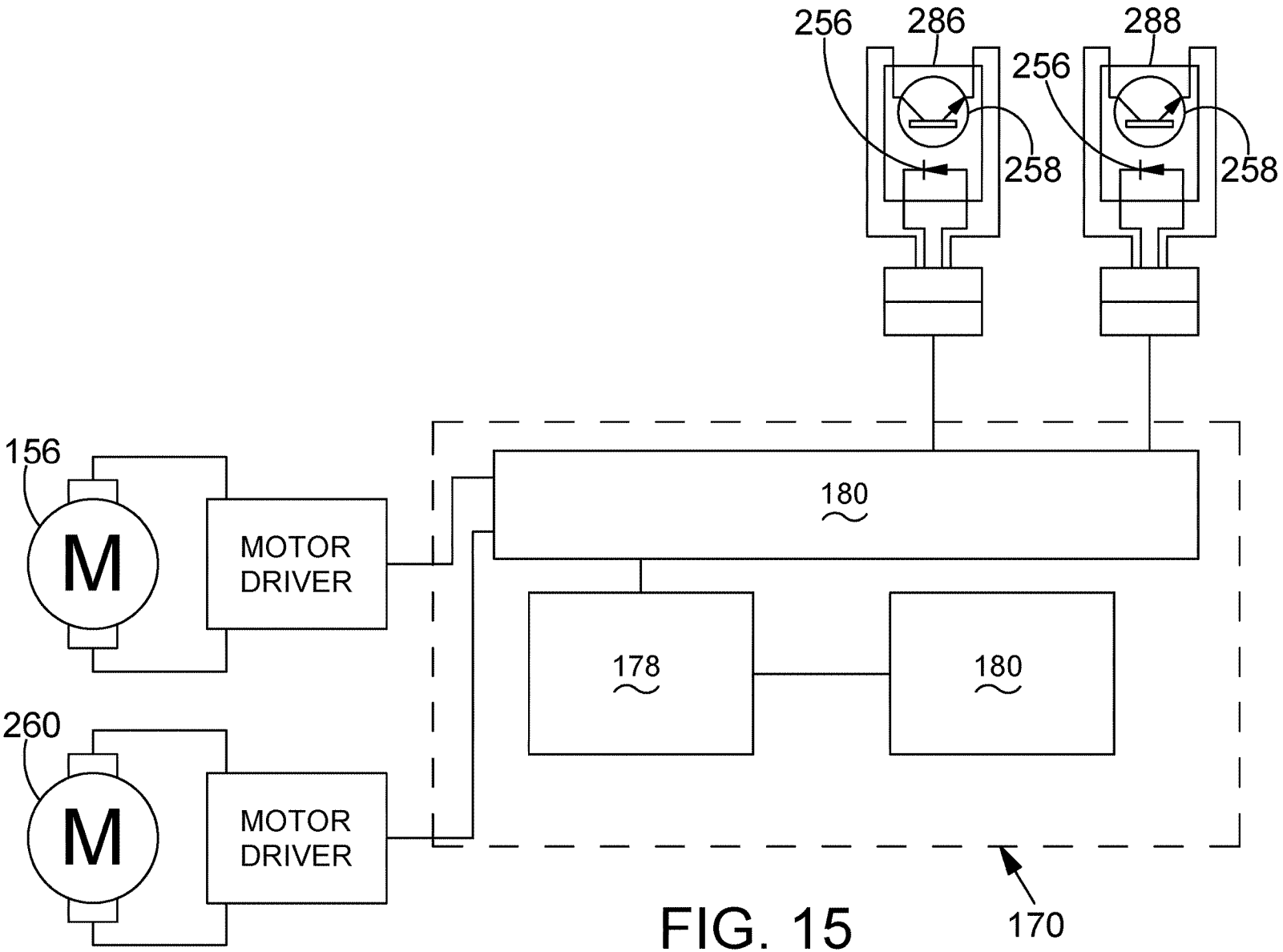
FIG. 15 is a stylized schematic showing circuitry operatively coupled to a lifting wheel motor, a sorter motor and a plurality of sensors.
Figure 16:
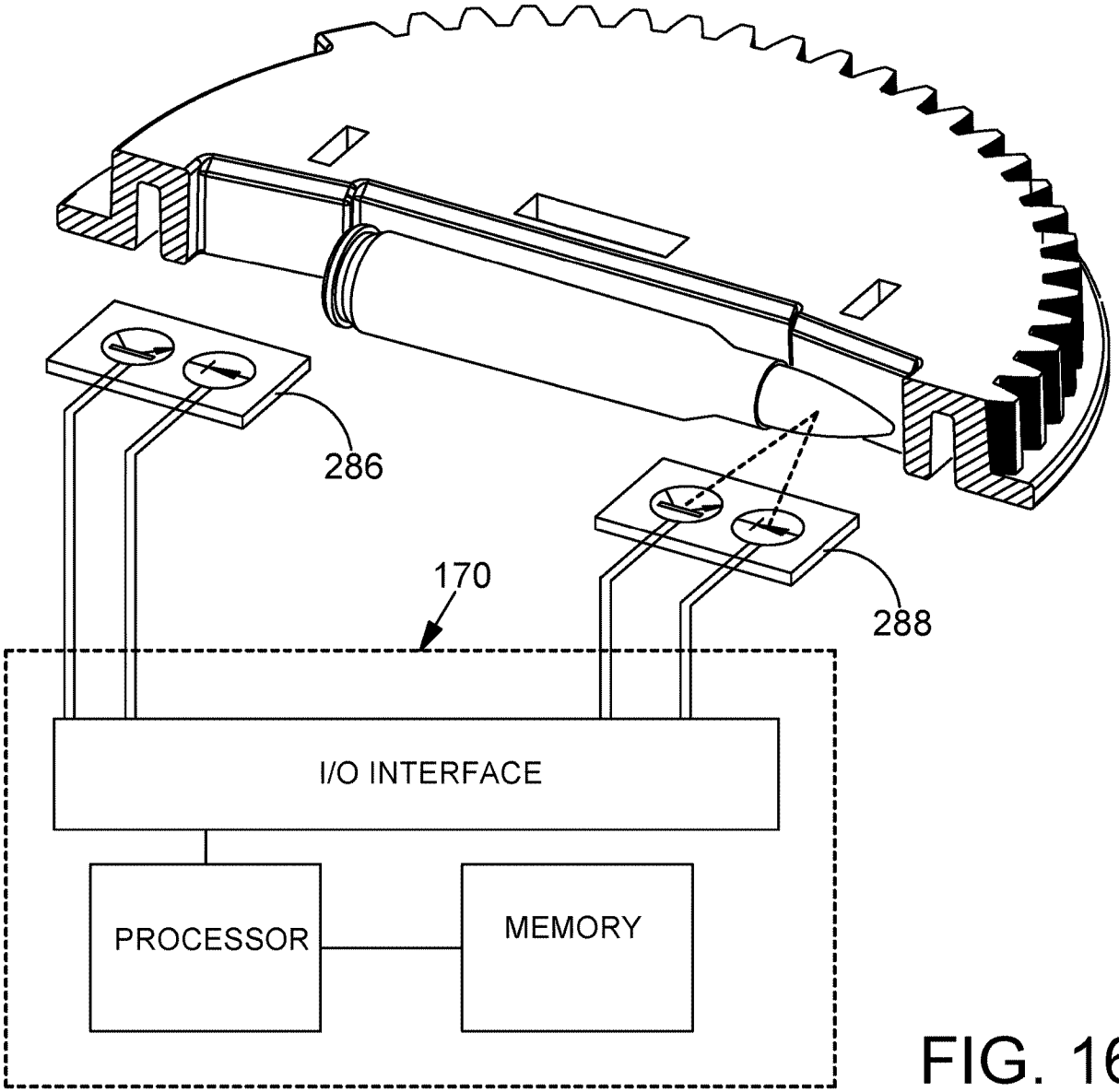
FIG. 16 is a stylized perspective view showing circuitry operatively coupled to a plurality of sensors.
Figure 17:
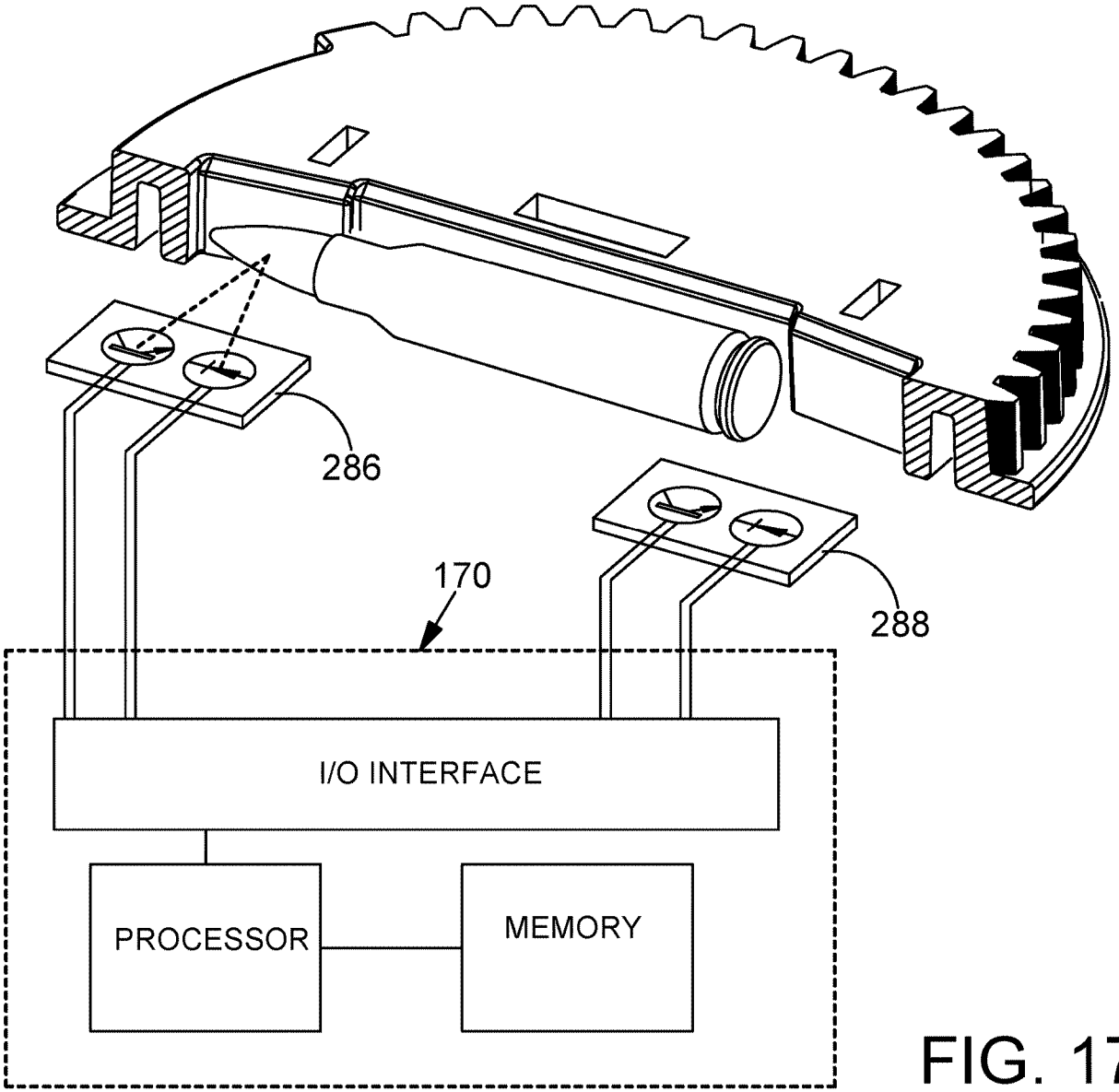
FIG. 17 is a stylized perspective view showing circuitry operatively coupled to a plurality of sensors.

Referring to FIG. 13A a top view is presented, the top view showing a toothed plate 150 that defines an opening 152 having a shape similar to the shape of the channel exit 134 defined by the chute body 140 shown in FIG. 11 and the lumen 146 defined by the guide 144 shown in FIG. 12. FIG. 13B is an elevation view of the toothed plate 150 and FIG. 13C is a top view of the toothed plate 150. FIGS. 13A-13B may be collectively referred to as FIG. 13. In the embodiment of FIG. 13, the opening 152 has a length, a width and a height. The toothed plate 150 may rotate during operation and assume various orientations. In one or more orientations, the length of the opening 152 extends in a portward direction and a starboard direction. In one or more orientations, the width of the opening 152 extends in a forward direction and a rearward direction. In one or more orientations, the height of the opening 152 extends in an upward direction and a downward direction.

Referring to FIGS. 3-6, a magazine loading apparatus for loading cartridges into a magazine comprises a base 102 pivotally supporting a gear 154 and a guide 144 defining a shaped lumen 146. In some embodiments, the shaped lumen 146 is dimensioned and configured to allow passage of cartridges having a random orientation, the random orientation being either a first orientation or a second orientation. The magazine loading apparatus also includes a sorter for selectively allowing a series of cartridges to exit the shaped lumen 146 defined by the guide 144. In some embodiments, the series of cartridges comprises a first cartridge, a second cartridge, and a third cartridge. The sorter receives the first cartridge and rotates the first cartridge from the first orientation to the second orientation if the random orientation of the first cartridge is the first orientation. The sorter allows passage of the first cartridge without rotation if the random orientation of the first cartridge is the second orientation.

Referring to FIGS. 6-10, the sorter may include a toothed plate 150, a gear 154 and a motor 156. In some embodiments, the toothed plate 150 defines an opening 152 that is dimensioned and configured to receive cartridges having either the first orientation or the second orientation. The toothed plate 150 includes a plurality of gear teeth 148 in some embodiments. The gear 154 may be pivotally supported by the base 102 at a position such that the gear 154 engages the gear teeth 148 of the toothed plate 150. In some embodiments, the motor 156 is operatively coupled to the gear 154, the motor 156 and the gear 154 being capable of selectively rotating the toothed plate 150 between a first position in which the opening 152 defined by the toothed plate 150 is generally aligned with the lumen 146 defined by the guide 144 and a second position in which the opening 152 defined by the toothed plate 150 is not aligned with the lumen 146 defined by the guide 144.

Referring to FIGS. 3-6, a magazine loading apparatus in accordance with some embodiments comprises a wheel 126, a bowl tray 120, and an aperture defining element 130 received in a tray opening 124 defined by the bowl tray 120. The bowl tray 120 defines a lower volume 194. In some embodiments, the bowl tray 120 is positioned so that an upper edge 118 of the bowl tray 120 meets a lower edge 116 of a bowl wall 108 with the bowl tray 120 and the bowl wall 108 cooperating to define a bowl cavity 122. The bowl cavity 122 is configured to receive a plurality of cartridges 24 in some embodiments.

Referring to FIGS. 3-6, a wheel 126 is disposed inside the bowl cavity 122 in some embodiments. In some embodiments, cartridges 24 are circulated upon rotation of the wheel 126 and pass through an aperture 132 defined by the aperture defining element 103 while the cartridges are assuming either a first orientation or a second orientation. A chute body 140 is positioned near the aperture defining element 130 in some embodiments. In some embodiments, the chute body 140 defines a channel 142. The channel 142 communicates with the aperture 132 and cartridges 24 that have passed through the aperture 132 enter the channel 142 in some embodiments. In some embodiments, the chute body 140 defines a channel exit 134 that communicates with the channel 142 and cartridges 24 that have passed through the channel 142 pass into the channel exit 134. A guide 144 is positioned near the channel exit 134 in some embodiments. In some embodiments, the guide 144 defines a shaped lumen 146 that communicates with the channel exit 134 defined by the chute body 140 and cartridges 24 that have passed through the channel exit 134 pass into the shaped lumen 146.

Referring to FIGS. 6-10, in some embodiments, the magazine loading apparatus includes a sorter for selectively allowing a series of cartridges to exit the shaped lumen 146 defined by the guide 144. The series of cartridges may include, for example, a first cartridge, a second cartridge, and a third cartridge. In some embodiments, the sorter receives the first cartridge and rotates the first cartridge from the first orientation to the second orientation if the random orientation of the first cartridge is the first orientation. The sorter may also allow passage of the first cartridge without rotation if the random orientation of the first cartridge is the second orientation. The sorter comprising a toothed plate 150 defining an opening 152 in some embodiments.

Referring to FIGS. 3-6, a magazine loading apparatus in accordance with some embodiments comprises a base 102 and a housing 104 supported by the base 102. In some embodiments, the housing 104 comprises an outer wall 106, a bowl wall 108, and a fillet wall 110 disposed between the outer wall 106 and the bowl wall 108. The fillet wall 110 and the bowl wall 108 define an upper opening 112 and an upper volume 114 fluidly communicating with the upper opening 112 in some embodiments. The magazine loading apparatus may also include a bowl tray 120 defining a lower volume 194. In some embodiments, the bowl tray is positioned so that an upper edge 118 of the bowl tray 120 meets a lower edge 116 of the bowl wall 108. The bowl tray 120 and the bowl wall 108 may cooperate to define a bowl cavity 122. In some embodiments, an aperture defining element 130 is received in a tray opening 124 defined by the bowl tray 120. The aperture defining element 130 may defining an aperture 132 that is dimensioned and configured to allow the passage of cartridges therethrough while the cartridges are assuming either a first orientation or a second orientation. The magazine loading apparatus may also include a wheel 126 disposed inside the bowl cavity 122 and a motor operatively coupled to the wheel 126 for rotating the wheel about a first axis. Upon rotation, the wheel 126 may circulates cartridges in the bowl cavity 122 whereby, cartridges circulated by the wheel pass through the aperture 132 defined by the aperture defining element while assuming either a first orientation or a second orientation.

The following United States patents are hereby incorporated by reference herein: U.S. Pat. Nos. 4,464,855, 4,689,909, 4,719,715, 4,827,651, 4,829,693, 4,888,902, 4,993,180, 5,249,386, 5,355,606, 5,377,436, 6,810,616, 6,178,683, 6,817,134, 7,059,077, 7,257,919, 7,383,657, 7,487,613, 7,503,138, 7,637,048, 7,805,874, 9,212,859, 9,239,198, 9,347,722 and 9,273,917.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention. The inventors of the magazine loaders described herein are associated with Fred Sparks Design of St. Louis, Mo.

What is claimed is:

1. A method for loading a plurality of cartridges into a magazine comprising:

receiving an unordered batch of cartridges within a circular hopper defining a bowl cavity, the circular hopper including a wheel disposed inside the bowl cavity, the wheel rotating about a rotational axis, the rotational axis being disposed at an acute angle relative to vertical, the wheel defining a plurality of cartridge receiving pockets, the pockets each configured to receive the cartridges in two directional orientations;

rotating the wheel so that a series of cartridges are received in the plurality of cartridge receiving pockets and each cartridge is lifted to an exit aperture extending through a wall of the circular hopper;

dropping a series of cartridges through the exit aperture and into a chute, the series of cartridges sliding down the chute in a horizontal orientation to stack against a pivotable plate of a sorter, the pivotable plate defining a shaped opening, the shaped opening being dimensioned and configured to receive an individual cartridge with each individual cartridge assuming a random directional orientation of one of two directional orientations, the random directional orientation being a first directional orientation and an opposite second directional orientation;

determining whether the random directional orientation of each of the series of cartridges received in the shaped opening is the first directional orientation or the second directional orientation;

rotating the pivotable plate clockwise 90 degrees if the random directional orientation of each of the series of cartridges received in the shaped opening is the first directional orientation;

rotating the pivotable plate counterclockwise 90 degrees if the random directional orientation of each of the series of cartridges received in the shaped opening is the second directional orientation;

allowing the given cartridge to fall through an exit slot defined by a stationary plate located below the pivoting plate so that each cartridge drops into the cartridge receiving region of a pusher mechanism whereby each cartridge is directionally oriented in the same direction;

inserting each of the series of cartridges, in a horizontal direction, into a captured magazine.

2. A magazine loader for loading cartridges into a magazine, comprising:

a circular hopper including a bowl portion defining a bowl cavity, the circular hopper including a lifting wheel disposed inside the bowl cavity, the lifting wheel having a drive system and being rotatable about a rotational axis, the rotational axis being disposed at an acute angle relative to vertical, the wheel defining a plurality of cartridge receiving pockets the pockets each configured to receive an individual cartridge in two directional orientations, the bowl portion defining an exit aperture communicating with the bowl cavity;

a chute positioned to receive the series of cartridges exiting the exit aperture, the chute configured to receive and transfer individual cartridges of the series of cartridges in a horizontal orientation and in either of the two directional orientations, to position the series of cartridges above a pivotable plate;

a sorter comprising the pivotable plate and a drive system for the pivotal plate, the pivotable plate defining a shaped opening dimensioned and configured to receive individual cartridges in the two directional rotations, the plate rotatable by the drive system in either of the two directional rotations, clockwise and counterclockwise, for orienting the series of cartridges in a single directional orientation;

the sorter having a gravity fed exit slot to a directionally oriented cartridge pathway, the pathway extending to a cartridge loading region adjacent a magazine receiver, the magazine receiver configured to secure a magazine to be loaded therein, a loader mechanism at the cartridge loading region, the loader mechanism having an powered pusher for horizontally loading individual cartridges in the cartridge loading region into a magazine secured in the magazine receiver.

3. The magazine loader of claim 2 further comprising circuitry operatively coupled to the sorter, wherein the circuitry comprises one or more processors and a non-transitory computer readable medium storing one or more instruction sets, wherein the one or more instruction sets include instructions configured to be executed by the one or more processors to cause the sorter to receive the first cartridge and rotate the first cartridge clockwise 90 degrees if the random directional orientation of the first cartridge is the first directional orientation and/or rotate the first cartridge counterclockwise 90 degrees if the random directional orientation of the first cartridge is the second directional orientation.

4. The magazine loader of claim 3 further including a first cartridge tip detector operatively coupled to the circuitry, the first cartridge tip detector being positioned such that the first cartridge tip detector detects the presence of a cartridge tip portion while a particular cartridge is received in the shaped opening and the particular cartridge is assuming the first directional orientation.

5. The magazine loader of claim 4 further including a second cartridge tip detector operatively coupled to the circuitry, the second cartridge tip detector being positioned such that the second cartridge tip detector detects the presence of a cartridge tip portion while a given cartridge is received in the shaped opening and the given cartridge is assuming the second directional orientation.

6. The magazine loader of claim 5 wherein each cartridge tip detector comprises a light source and a light sensor.

7. The magazine loader of claim 6 wherein the light source and the light sensor are positioned such that light emitting from the light source illuminates a portion of the cartridge tip and the light sensor provides a signal responsive to light reflected off of the cartridge tip when the cartridge tip is in the closed position.

8. The magazine loader of claim 7 wherein the light source comprises a light emitting diode (LED) and the light sensor comprises a phototransistor.

9. The magazine loader of claim 3 wherein the pivotable plate comprises a plurality of gear teeth and the magazine loader further comprises a gear pivotally supported by a base, the gear being positioned such that the gear engages the gear teeth of the pivotable plate.

10. The magazine loader of claim 9 further comprising a motor operatively connected to the circuitry, the motor comprising a shaft coupled to the gear, the motor and the gear being capable of selectively rotating the pivotable plate between a first position in which the opening defined by the pivotable plate is generally aligned with the passageway defined by the guide and a second position in which the opening defined by the pivotable plate is not aligned with the passageway defined by the guide.

11. A magazine loader for loading cartridges into a magazine, comprising:

a bowl portion defining a bowl cavity configured to receive a plurality of cartridges;

a rotatable lifting wheel disposed inside the bowl cavity, the lifting wheel circulating cartridges in the bowl upon rotation thereof;

a chute entry positioned at an upper region of the bowl, the chute entry being dimensioned and configured to allow passage of individual cartridges generally in a horizontal orientation there through while each cartridge is assuming a random directional orientation of one of two directional orientations, the random directional orientation being a first directional orientation or a second directional orientation, the first directional orientation being opposite the second directional orientation;

a chute body defining a channel, the channel communicating with the aperture, wherein cartridges that have passed through the chute entry pass down the channel in a horizontal orientation;

the chute body defining a channel exit, the channel exit communicating with the channel, wherein cartridges that have passed through the channel pass out the channel exit in a horizontal orientation;

a sorter comprising a feed guide defining a shaped passageway, the shaped passageway communicating with the channel exit defined by the chute body, wherein cartridges that have passed through the channel exit pass into the shaped passageway and seat therein in a horizontal orientation and in either of two directional orientations, the sorter further comprising a rotatory plate positioned below the feed guide, the sorter having a directional orientation detector, the rotary plate receives a cartridge from the feed guide and depending on orientation rotates the plate to orient the cartridges in a common directional orientation and discharge the cartridges to a pusher mechanism opposite a magazine receiver for pushing the horizontal cartridges into a magazine secured by the magazine receiver.

12. The magazine loader of claim 11 further comprising circuitry operatively coupled to the sorter, wherein the circuitry comprises one or more processors and a non-transitory computer readable medium storing one or more instruction sets, wherein the one or more instruction sets include instructions configured to be executed by the one or more processors to cause the sorter to receive the first cartridge and rotate the first cartridge clockwise 90 degrees if the random directional orientation of the first cartridge is the first directional orientation and/or rotate the first cartridge counterclockwise 90 degrees if the random directional orientation of the first cartridge is the second directional orientation.

13. The magazine loader of claim 12 wherein the one or more instruction sets include instructions configured to be executed by the one or more processors to cause the sorter to receive the second cartridge and rotate the second cartridge clockwise 90 degrees if the random directional orientation of the second cartridge is the first directional orientation and/or rotate the second cartridge counterclockwise 90 degrees if the random directional orientation of the second cartridge is the second directional orientation.

14. The magazine loader of claim 13 wherein the one or more instruction sets include instructions configured to be executed by the one or more processors to cause the sorter to receive the third cartridge and rotate the third cartridge clockwise 90 degrees if the random directional orientation of the third cartridge is the first directional orientation and/or rotate the third cartridge counterclockwise 90 degrees if the random directional orientation of the third cartridge is the second directional orientation.

15. The magazine loader of claim 12 further including a first cartridge tip detector operatively coupled to the circuitry, the first cartridge tip detector being positioned such that the first cartridge tip detector detects the presence of a cartridge tip portion while a particular cartridge is received in the shaped opening and the particular cartridge is assuming the first directional orientation.

16. The magazine loader of claim 15 further including a second cartridge tip detector operatively coupled to the circuitry, the second cartridge tip detector being positioned such that the second cartridge tip detector detects the presence of a cartridge tip portion while a given cartridge is received in the shaped opening and the given cartridge is assuming the second directional orientation.

17. The magazine loader of claim 16 wherein each cartridge tip detector comprises a light source and a light sensor.

18. The magazine loader of claim 17 wherein the light source and the light sensor are positioned such that light emitting from the light source illuminates a portion of the cartridge tip and the light sensor provides a signal responsive to light reflected off of the cartridge tip when the cartridge tip is in the closed position.

19. The magazine loader of claim 18 wherein the light source comprises a light emitting diode (LED) and the light sensor comprises a phototransistor.

20. The magazine loader of claim 19 wherein the pivotable plate comprises a plurality of gear teeth and the magazine loader further comprises a gear pivotally supported by a base, the gear being positioned such that the gear engages the gear teeth of the pivotable plate.

21. The magazine loader of claim 20 further comprising a motor operatively connected to the circuitry, the motor comprising a shaft coupled to the gear, the motor and the gear being capable of selectively rotating the pivotable plate between a first position in which the opening defined by the pivotable plate is generally aligned with the passageway defined by the guide and a second position in which the opening defined by the pivotable plate is not aligned with the passageway defined by the guide.

* * * * *